US010486843B2

(12) United States Patent
Ours et al.

(10) Patent No.: US 10,486,843 B2
(45) Date of Patent: Nov. 26, 2019

(54) TRANSPORTABLE CONTAINER FOR BULK GOODS AND METHOD FOR FORMING THE SAME

(71) Applicant: Kellogg Company, Battle Creek, MI (US)

(72) Inventors: David C. Ours, Marshall, MI (US); Sharon B. Juntunen, Portage, MI (US)

(73) Assignee: KELLOGG COMPANY, Battle Creek, MI (US)

( * ) Notice: Subject to any disclaimer, the term of this patent is extended or adjusted under 35 U.S.C. 154(b) by 932 days.

(21) Appl. No.: 14/818,934

(22) Filed: Aug. 5, 2015

(65) Prior Publication Data

US 2015/0336700 A1 Nov. 26, 2015

Related U.S. Application Data

(62) Division of application No. 13/308,716, filed on Dec. 1, 2011, now Pat. No. 9,126,705.

(Continued)

(51) Int. Cl.
*B65B 43/26* (2006.01)
*B65B 43/62* (2006.01)

(Continued)

(52) U.S. Cl.
CPC ..... *B65B 43/62* (2013.01); *B65B 1/02* (2013.01); *B65B 5/101* (2013.01); *B65B 11/025* (2013.01);

(Continued)

(58) Field of Classification Search
CPC ..... B65B 43/26; B65B 43/46; B65B 43/54

(Continued)

(56) References Cited

U.S. PATENT DOCUMENTS 2,601,480 A * 6/1952 Williams ..... B65B 43/36 493/255
2,973,612 A * 3/1961 McGowan ..... B65B 43/30 141/166

(Continued)

FOREIGN PATENT DOCUMENTS

JP 2008-535743 9/2008
JP 2011-524310 9/2011

(Continued)

OTHER PUBLICATIONS

International Search Report for PCT/US2005/024564 dated Nov. 18, 2005.

*Primary Examiner* — Gloria R Weeks
(74) *Attorney, Agent, or Firm* — Honigman LLP; Kathryn D. Doyle, Esq.; Jonathan P. O'Brien

(57) ABSTRACT

The packaging system forms a transportable container for bulk goods having stretch wrap that is spirally wrapped about a bottom support and bulk goods to define the transportable container. The stretch wrap contacts at least a portion of the bulk goods to squeeze and lock together the bulk goods. During filling, the bottom support of the transportable container lowers as the transportable container is formed to accommodate additional bulk goods. The stretch wrap is prestretched from a non-stretched state to a stretched state prior to disposing the wrap about a slip frame former in the stretched state. The wrap returns to its non-stretched state as it is disengaged from the slip frame former to squeeze and lock together the bulk goods disposed therein. The packaging system results in a transportable container that is optimally packed and shaped for the efficient filling of a truck for shipping.

20 Claims, 13 Drawing Sheets

Related U.S. Application Data

(60) Provisional application No. 61/418,448, filed on Dec. 1, 2010.

(51) Int. Cl.

| | |
|---|---|
| ***B65D 61/00*** | (2006.01) |
| ***B65B 5/10*** | (2006.01) |
| ***B65B 53/00*** | (2006.01) |
| ***B65B 1/02*** | (2006.01) |
| ***B65B 43/58*** | (2006.01) |
| ***B65B 11/02*** | (2006.01) |
| *B65B 11/00* | (2006.01) |

(52) U.S. Cl.
CPC ..... *B65B 43/58* (2013.01); *B65B 53/00* (2013.01); *B65D 61/00* (2013.01); *B65B 2011/002* (2013.01); *B65B 2210/16* (2013.01); *B65B 2210/18* (2013.01)

(58) Field of Classification Search
USPC ..... 53/384.1, 381.1
See application file for complete search history.

(56) References Cited

U.S. PATENT DOCUMENTS 2,986,860 A * 6/1961 Salzwedel ..... B67B 5/03 156/DIG. 15
3,243,937 A * 4/1966 Ragan ..... B65B 43/34 53/384.1
3,269,430 A * 8/1966 Belk ..... B65B 43/54 141/315
3,279,523 A * 10/1966 Pardue ..... B60K 15/06 137/571
3,284,986 A * 11/1966 Duchin ..... B65B 67/04 53/261
3,287,881 A * 11/1966 Jelling ..... B65B 43/123 53/241
3,509,680 A * 5/1970 Weber ..... B41F 17/26 206/459.5
3,903,677 A * 9/1975 Bowman ..... B65B 9/14 53/381.1
4,078,358 A * 3/1978 Henderson ..... B65B 39/08 53/459
4,263,768 A * 4/1981 Russell ..... B65B 43/465 198/803.4
4,687,462 A * 8/1987 Rewitzer ..... B65B 43/26 493/100
5,351,465 A * 10/1994 Fortnam ..... B65B 43/34 53/384.1
5,467,578 A * 11/1995 Jensen ..... B65B 5/045 53/284.7
5,475,966 A * 12/1995 Renfrow ..... B43M 7/02 493/409
5,581,982 A * 12/1996 Schroeder ..... B65B 1/32 53/459
5,588,278 A * 12/1996 Wynn ..... B65B 13/022 100/9
5,657,619 A * 8/1997 Fujikawa ..... A45B 25/24 53/384.1
5,740,662 A * 4/1998 Royneberg ..... A01F 15/071 53/211
5,778,642 A 7/1998 Fuss et al.
6,531,096 B1 * 3/2003 Deveney ..... B65B 69/00 422/549
6,550,967 B2 * 4/2003 Hedaya ..... A45C 13/004 383/127
6,604,344 B2 * 8/2003 Bussey, Jr. ..... B29C 65/745 141/166
6,886,308 B2 * 5/2005 Gates ..... B65B 43/36 248/100
6,976,350 B2 * 12/2005 Greening ..... B65B 43/44 53/384.1
7,013,625 B2 * 3/2006 Curles ..... B65B 43/267 53/261
7,882,685 B2 * 2/2011 Koga ..... B65B 43/465 53/570
8,151,543 B2 * 4/2012 Veix ..... B65B 43/26 141/166
8,245,635 B2 * 8/2012 Kim ..... B65B 57/04 100/9
8,562,274 B2 10/2013 Murray
8,617,021 B1 * 12/2013 Goleski ..... F16H 3/666 475/277
8,800,251 B2 * 8/2014 Brinkman ..... B65B 43/28 53/260
9,771,174 B2 * 9/2017 Murray ..... B65B 39/02
2005/0166554 A1 * 8/2005 Gates ..... B65B 43/36 53/459
2009/0308031 A1 * 12/2009 Koga ..... B65B 43/465 53/570
2010/0269458 A1 * 10/2010 Veix ..... B65B 43/26 53/570

FOREIGN PATENT DOCUMENTS

WO 2006023155 3/2006
WO 2006-110596 10/2006

* cited by examiner

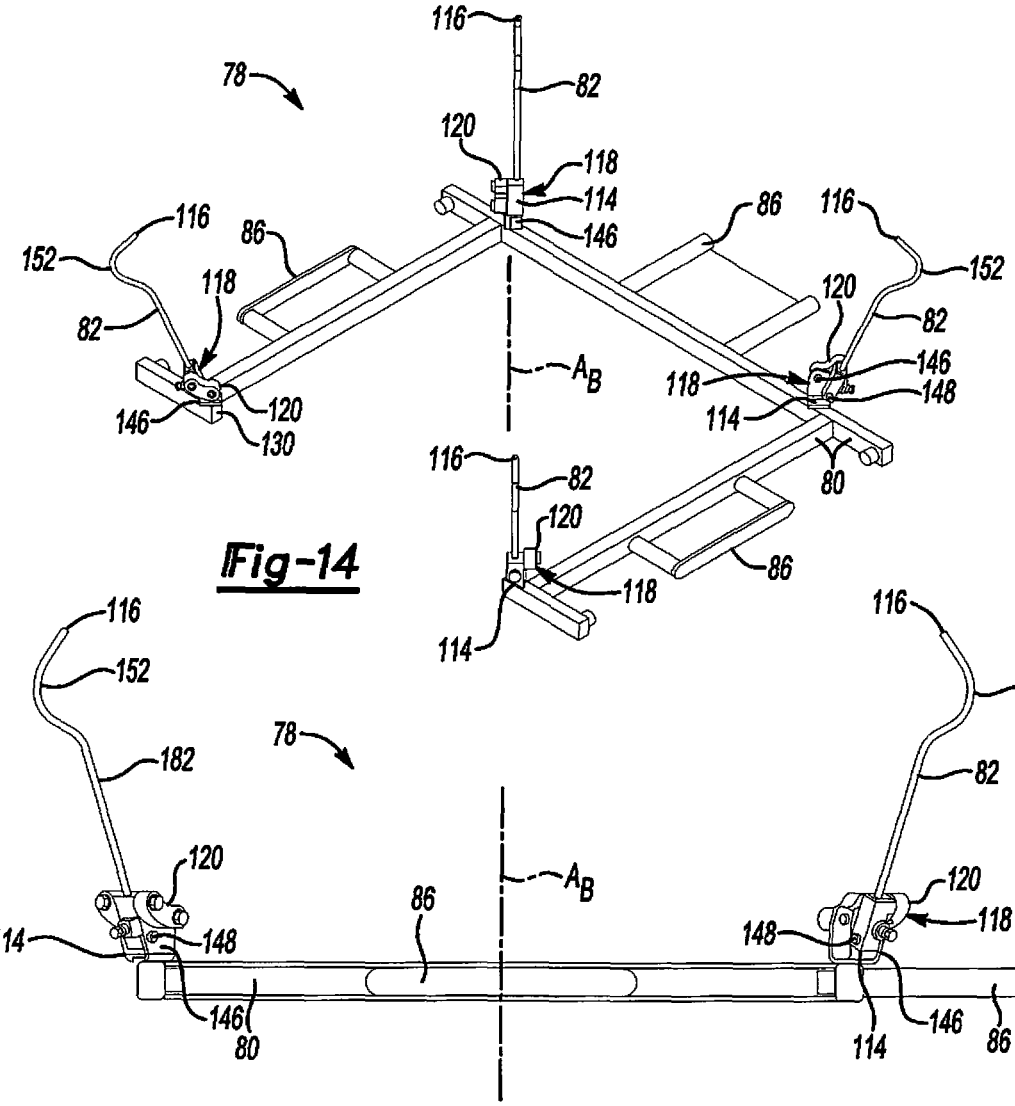
Fig-14
Fig-15
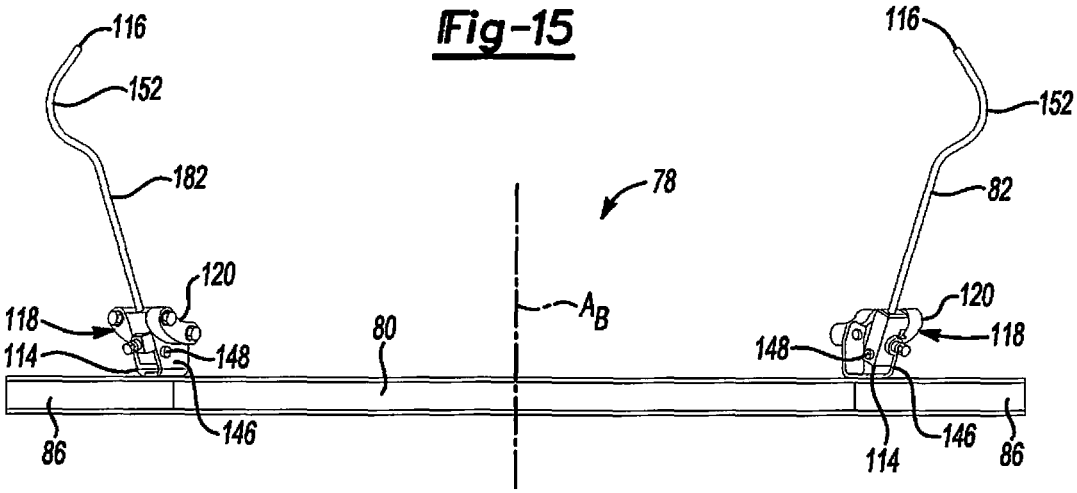
Fig-16

TRANSPORTABLE CONTAINER FOR BULK GOODS AND METHOD FOR FORMING THE SAME

CROSS REFERENCE TO RELATED APPLICATION

This application is a divisional of U.S. patent application Ser. No. 13/308,716, filed Dec. 1, 2011, which claims the benefit of U.S. Provisional Patent Application Ser. No. 61/418,448 for TRANSPORTABLE CONTAINER FOR BULK GOODS AND METHOD FOR FORMING THE SAME, filed on Dec. 1, 2010, which are hereby incorporated by reference in their entirety.

BACKGROUND OF THE INVENTION

1. Field of the Invention

The subject invention relates to a transportable container of bulk goods and more particularly a packaging system for filling and forming the transportable container of bulk goods.

2. Description of the Prior Art

Systems for packaging a plurality of bulk goods in transportable containers are known in the art. Typical transportable containers utilized for the transport of bulk goods are inefficient, do not have a very large volume, and often require a large amount of manual labor to be used in filling and handling of the transportable container. It is further known in the art to apply a stretch wrap about a plurality of individual products stacked on a pallet to stabilize the products for shipping in bulk.

One such patent is U.S. Pat. No. 7,921,624. The '624 patent discloses a method of producing a transportable container of bulk goods. To begin, a bag is placed through the frame opening of a slip frame former which surrounds a portion of the bag. The bag receives the bulk goods from a feed source. A stretch wrap is disposed radially about a bottom support and a portion of the slip frame former to initially form the transportable container. At least one of the slip frame former and the bottom support moves relative to other in response to the fill level of the bulk goods in the bag. During filling, the slip frame former is maintained at a position that surrounds the fill level of the bulk goods in the bag. As the fill level increases in the bag, previously disposed portions of stretch wrap are disengaged from the slip frame former to squeeze the filled portion of the bag and lock together the bulk goods as additional portions of stretch wrap are disposed around the slip frame former.

Another such patent is U.S. Pat. No. 5,477,658. The '658 patent discloses a method of palletizing peat moss in a bulk compressed form. The method holds a predetermined quantity of peat moss stacked vertically on a pallet to be confined to a desired, compressed shape. The '658 patent further discloses that the peat moss is downwardly compressed directly onto the pallet so as to form the peat moss into a coherent, shape-retaining body. The body of compressed peat moss maintains a structural integrity for a period of time sufficient to permit wrapping thereof. Such a body of compressed peat moss is then wrapped to retain the peat moss in the compressed form on the pallet. The wrapping unit used wraps a plastic film material around the outer surface of the peat moss body.

Another such patent is U.S. Pat. No. 6,594,970. The '970 patent discloses a method and apparatus for wrapping an outer wrap around layers of products on a pallet. The system of the '970 patent uses four guides, with one of the guides being disposed on each side of the load being wrapped, which act as a barrier between the layers of products and the outer wrap. To begin, the pallet is placed at a location adjacent the guides and layers of products are added to the pallet. The products have a perimeter of a given shape, and are disposed in an array on the pallet to form the layers of products. As the layers of products are added to the pallet, the pallet is moved downwardly from the guides to allow for the outer wrap to be applied to the products to secure and stabilize them.

Another such patent is U.S. Pat. No. 7,707,801. The '801 patent discloses an apparatus for dispensing a predetermined fixed amount of pre-stretched film based upon the girth of the load. A film dispenser is mounted on a rotating ring that allows for the movement of the film dispenser about the load being wrapped. Based upon the girth of the load to be wrapped, an amount of pre-stretched film to be dispensed for each revolution made by the rotating ring is determined. Once the amount of film to be dispensed per revolution is determined, a mechanical ratio of ring drive to final pre-stretch surface speed (i.e., number of pre-stretch roller revolution/ring rotation) is set. Thus, for each revolution of the film dispenser, a predetermined fixed amount of film is dispensed and wrapped around the load.

Another such patent is U.S. Pat. No. 6,176,276. The '276 patent discloses a device for feeding a granular material from a feed source to a container for transporting. The device includes a conduit for receiving a flow of granular material and further includes an outlet for delivering the granular material to the transportable container. The device includes a delivery system for delivering a stream of gas to the conduit to entrain and accelerate at least a portion of the granular material flowing therethrough. The device further includes an apparatus that directs the gas stream so that the granular material is propelled from the outlet in a plurality of directions. The apparatus provides for a more even distribution of the granular material in the transportable container. The desired effect of the device is to provide a distribution of polymer beads which results in a very efficient filling of the container.

SUMMARY OF THE INVENTION

The packaging system and methods of the present invention form a transportable container for bulk goods having a bottom support and stretch wrap spirally wrapped about the bottom support. The stretch wrap extends vertically from the bottom support to define the transportable container. The transportable container includes a plurality of bulk goods that are secured within the stretch wrap. The stretch wrap contacts at least a portion of the plurality of bulk goods to squeeze and lock together the plurality of bulk goods disposed within the transportable container.

The present invention provides for a method of producing a transportable container for supporting bulk goods. The method begins by positioning a non-rotating slip frame former adjacent a non-rotating bottom support. The slip frame former surrounds a portion of the transportable container and defines a frame opening for receiving the bulk goods from a feed source. A stretch wrap, disposed from a rotary stretch wrapping device, is prestretched from a non-stretched state to a stretched state prior to being disposed from the rotary stretch wrapping device to the transportable container. To initially form the transportable container, the rotary stretch wrapping device is rotated radially about the non-rotating slip frame former and non-rotating bottom support to dispose the stretch wrap in the stretched state radially about the bottom support and a portion of the slip frame former. Next, the transportable container is filled with bulk goods from the feed source through the frame opening. At least one of the slip frame former and the bottom support are vertically moved relative to other in response to the fill level of the bulk goods in the transportable container. The slip frame former and the bottom support are vertically moved relative to other to expose the filled portion of the transportable container therebetween, as the transportable container is filled with bulk goods. In the preferred embodiment, the bottom support of the transportable container lowers as the transportable container is filled and formed. The vertical movement of the bottom support downward is controlled based on the amount of bulk goods in the transportable container. The slip frame former is maintained in a position to surround at least a portion the bulk goods in the transportable container. Previously disposed portions of the stretch wrap are disengaged from the slip frame former to allow the stretch wrap to return to the non-stretched state and squeeze the filled portion of the transportable container and lock together the bulk goods disposed therein as at least one of the slip frame former and the bottom support moves relative to other.

The above method provides for a method of forming a transportable container of bulk goods that includes the steps of prestretching a stretch wrap from a non-stretched state to a stretched state and disposing the wrap from a rotary stretch wrapping device about a non-rotating slip frame former in the stretched state. Further, the above method provides for a method of forming a transportable container wherein the previously disposed portions of stretch wrap are disengaged from the slip frame former to engage the filled portion of the transportable container and which allows the stretch wrap to return to the non-stretched state to squeeze the filled portion of the transportable container and lock together the bulk goods disposed therein.

The present invention further provides for a method of optimally packaging a transportable container of bulk goods. The method begins by placing a bag with an open top and a closed base through a frame opening defined by a slip frame former. The slip frame former includes at least one wall that extends between a former top and a former bottom. The slip frame former surrounds a portion of the bag with the closed base of the bag being disposed adjacent a bottom support and the open top of the bag being vertically spaced from the closed base and disposed adjacent a feed source. A stretch wrap is disposed from a stretch wrapping device radially about the bottom support and a portion of the slip frame former to initially form the transportable container. A fill level of bulk goods is established in the bag vertically above the former top of the slip frame former. At least one of the slip frame former and the bottom support are vertically moved relative to other in response to the fill level of the bulk goods in the bag to expose the filled portion of the bag therebetween as the bag is filled with bulk goods. In the preferred embodiment, the bottom support of the transportable container lowers as the transportable container is filled and formed. The vertical movement of the bottom support downward is controlled based on the amount of bulk goods in the transportable container. The former top of the slip frame former is maintained in a position below the fill level of the bulk goods in the bag. Additional portions of stretch wrap are disposed around a portion of the at least one former wall of the slip frame former to maintain the transportable container for receiving bulk goods as previously disposed portions of stretch wrap disengage the slip frame former during the vertically moving step. The fill level of bulk goods is maintained vertically above the former top of the slip frame former during the vertically moving step to create a head of bulk goods during the forming of the transportable container. The head of bulk goods allows for settling of the bulk goods in the transportable container and aids in the shaping and optimal filling of the transportable container. The fill level of bulk goods further allows for a more compact transportable container with less voids between the bulk goods and more bulk goods disposed within the transportable container.

The present invention further provides for an intermediate carrier device for holding a scrunched bag to form the transportable container for housing a plurality of bulk goods. The bag disposed on the intermediate carrier device includes an open end and a closed base. The intermediate carrier includes a rigid carrier base that is disposed about a base axis. A plurality of carrier arms are pivotally connected to the base and extend between a first arm end and a second arm end. Each of the carrier arms extend outwardly from the base to hold the bag in a scrunched position. Each of the carrier arms are pivotally connected to the base at the first arm end to pivot each of the carrier arms at the first arm end to allow the second arm end to move radially inward and outward. An elastomeric joint is disposed adjacent the pivotal connection between each of the first arm ends and the carrier base to bias each of the second arm ends radially outward. The biasing of the second arm ends radially outward provides tension against the bag from each of the second arm ends to hold the bag in the scrunched position.

The packaging system and methods of the present invention provide several advantages over previous systems. The packaging system and methods of the present invention have a reduced cost, improved reliability, and is easier to clean. In addition, the speed and time to produce a transportable container is significantly improved. For example, the packaging system of the present invention can handle 50 plus cubic feet per minute of bulk goods with storage upstream.

The packaging system and methods of the present invention result in a transportable container with optimal packing. That is, the transportable container is shaped to allow for the efficient filling of a truck for shipping. The packaging system and methods allow for increased product in each of the transportable containers which results in a reduction to materials cost and handling. In addition, the packaging system results in a reduction in breakage of fragile products.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 14 is perspective view of the intermediate carrier according the subject invention;

FIG. 15 is a side view of the intermediate carrier according the subject invention;

FIG. 16 is a front view of the intermediate carrier according the subject invention.

DETAILED DESCRIPTION OF THE ENABLING EMBODIMENTS

Referring to the Figures, wherein like numerals indicate corresponding parts throughout the several views, a transportable container 20 of bulk goods 22 and more particularly a packaging system 24 for filling and forming the transportable container 20 of bulk goods 22 are generally shown.

Throughout the present specification and claims the phrase "bulk goods" is used as a shorthand version of the wide range of products that can be packaged utilizing the present invention. The present invention finds utilization in packaging any material that can be bulk packaged. These items can encompass large bulk packaged pieces as well as very small bulk packaged pieces. Examples of smaller bulk goods include, but are not limited to, the following: agricultural products like seeds, rice, grains, vegetables, fruits, chemical products like fine chemicals, pharmaceuticals, raw chemicals, fertilizers, plastics like plastic resin pellets, plastic parts, rejected plastic parts, machined plastic parts, cereals and cereal products such as wheat, a variety of machined parts of all sorts, wood products like wood chips, landscaping material, peat moss, dirt, sand, gravel, rocks and cement. The present invention also finds utilization in bulk packaging of larger bulk goods including, but not limited to: prepared foods, partially processed foods like frozen fish, frozen chicken, other frozen meats and meat products, manufactured items like textiles, clothing, footwear, toys like plastic toys, plastic half parts, metallic parts, soft toys, stuffed animals, and other toys and toy products. All of these types of materials and similar bulk packaged materials are intended to be encompassed in the present specification and claims by this phrase. In addition to bulk goods 22, the packaging system 24 of the present invention can be tailored to work with flowable liquids. It should be noted that when liquids are used, the overall height of the transportable container 20 may be smaller than a transportable container 20 having conventional bulk goods 22. In addition, the shape of the transportable may be adjusted to accommodate flowable liquids. For example, the transportable container 20 may be rounded as opposed to generally square.

Figure 1:
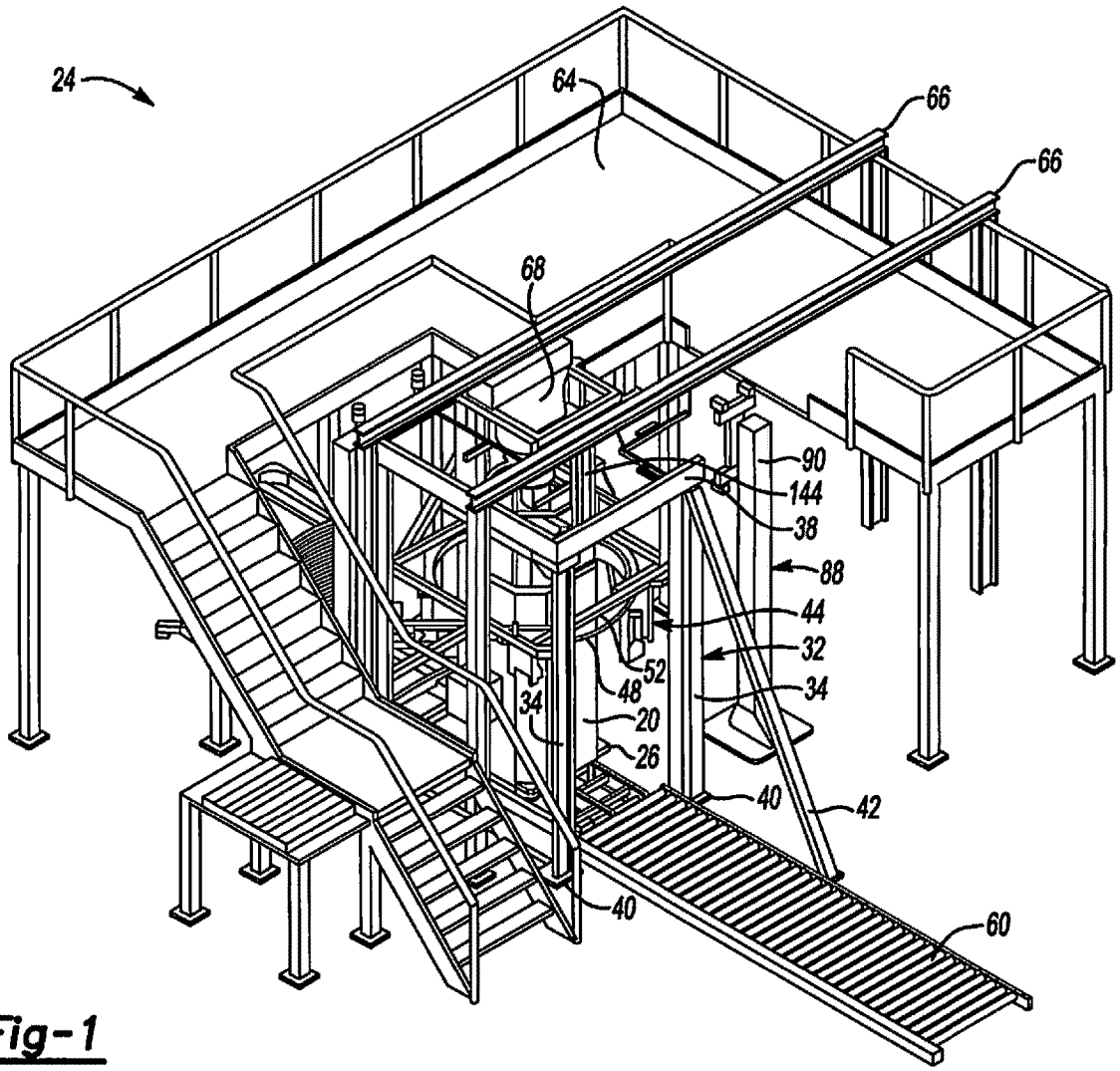
FIG. 1 is a perspective view of the packaging system according the subject invention.

The packaging system 24, as shown in FIG. 1, forms a transportable container 20 for bulk goods 22 having a bottom support 26 and stretch wrap 54 spirally wrapped around the bottom support 26 and the bulk goods 22. The stretch wrap 54 extends vertically upward from the bottom support 26 to form the transportable container 20. The transportable container 20 includes a plurality of bulk goods 22 that are disposed within the stretch wrap 54. The stretch wrap 54 contacts at least a portion of the plurality of bulk goods 22 to squeeze and lock together the plurality of bulk goods 22 disposed in the transportable container 20. While the transportable container 20 of the preferred embodiment includes a bag 28 between the bulk goods 22 and stretch wrap 54 for receiving the bulks goods, no bag 28 is needed between the bulk goods 22 and stretch wrap 54 to form the transportable container 20.

The packaging system 24 includes a conventional rotary stretch wrapping device 30 such as, for example, a Lantech RS Ring Straddle stretch wrapper. Examples of other conventional rotary stretch wrapping devices 30 include, but are not limited to, an Octopus stretch wrapping machine and ITW Signode Rotary Ring stretch wrapper. It should be appreciated that any conventional rotary stretch wrapping device 30 known in the art could be used.

In the exemplary embodiment, the rotary stretch wrapping device 30 of the packaging system 24 includes a frame 32. The frame 32 is non-rotating and includes a plurality of vertical legs 34 to support the frame 32 in a standing, up-right position. While the exemplary embodiment includes four vertical legs 34, any number of vertical legs 34 may be used to support the frame 32 in a standing, up-right position. The frame 32 also includes an upper support 36 having a plurality of horizontal supports 38 that connect the vertical legs 34 to each other, forming the frame 32 having a square or rectangular shape. The vertical legs 34 extend downwardly from the upper support 36 to form the frame 32. In the exemplary embodiment, the frame 32 includes three horizontal supports 38, but any number of horizontal supports 38 may be used. In addition to the horizontal supports 38 and vertical legs 34, additional support mechanisms may be used to provide support to the frame 32. Additional support mechanisms could include, but are not limited to, base supports 40 disposed at the bottom of each vertical leg 34 or angle supports 42 that extend angularly from the frame 32.

Connected to and movable along the frame 32 is a vertically movable wrapping portion 44. The wrapping portion 44 moves vertically along the vertical legs 34 of the frame 32. The vertically movable wrapping portion 44 includes a support portion 46, a ring portion 48 secured to and vertically moveable with the support portion 46, and a film dispenser 50 for applying stretch wrap 54 to form the transportable container 20. The ring portion 48 is circular and defines a ring opening 52 that surrounds a transportable container 20 during filling. The ring portion 48 is a circular rod, tube or track that defines the path of movement for the film dispenser 50. In the exemplary embodiment, the ring portion 48 is stationary to allow the film dispenser 50 to be moved or driven along the ring portion 48. A motor may serve to drive the film dispenser 50 along the ring portion 48. In an alternative embodiment, the ring portion 48 is rotatable and the film dispenser 50 is secured thereto for rotation with the ring portion 48. A motor may serve to drive the ring portion 48 and the film dispenser 50 secured thereto.

According to one aspect of the present invention, the film dispenser 50 is mounted on the ring portion 48, which is supported by the support portion 46 of the vertically moveable wrapping portion 44. The film dispenser 50 rotates about a vertical axis as the vertically moveable wrapping portion 44 spirally wraps the stretch wrap 54 about the transportable container 20. The film dispenser 50 is mounted underneath and outboard of the ring portion 48, but may be mounted above or inward of the ring portion 48. While in the exemplary embodiment, the film dispenser 50 maintains its vertical position during filling, the film dispenser 50 could be moved vertically upwardly and downwardly with the support portion 46 if needed. For example, after the transportable container 20 is formed, the film dispenser 50 may be moved vertically upward and downward to apply additional layer of stretch wrap 54 about the transportable container 20 to stabilize the transportable container 20.

The film dispenser 50 further includes a wrap head having a roll of outer wrap secured on a wrap head base. In the preferred embodiment, the outer wrap is a stretch wrap 54 having a high cling factor and a width between 10 and 30 inches, but the stretch wrap 54 may be any of a variety of stretch wrap 54 films known in the art. Other packaging materials such as netting, strapping, banding, or tape may be used as well. As used herein, the terms "stretch wrap," "outer wrap," "packaging material," "film," "web," and "film web" are interchangeable. The stretch wrap 54 may have a high coefficient of friction, which may lead to delaminating problems. Delaminating may be reduced by applying a glue between layers of stretch wrap 54, welding the stretch wrap 54 layers or any other method of reducing delaminating known in the art. Welding the stretch wrap 54 may include, but is not limited to, heat or sonic welding.

The film dispenser 50 may include a pre-stretch assembly 140 that is configured to pre-stretch the stretch wrap 54 prior to being applied to the transportable container 20 and the bulk goods 22 disposed therein. The pre-stretch assembly 140 pre-stretches the stretch wrap 54 from a non-stretched state to a stretched state to be applied to the transportable container 20. The pre-stretch assembly 140 may be any pre-stretch assembly 140 known in the art. In the exemplary embodiment, the pre-stretch assembly 140 includes a plurality of pre-stretch rollers 142. The pre-stretch assembly 140 maintains the surface speed of a downstream pre-stretch roller 142 at a speed which is faster than the speed of an upstream pre-stretch roller 142 to stretch the stretch wrap 54 between the pre-stretch rollers 142. This stretching of the stretch wrap 54 allows for controlling the force of the stretch wrap 54 as it is applied to the bulk goods 22 of the transportable container 20. The pre-stretch assembly 140 controls the feed of the stretch wrap 54 to the transportable container 20 as opposed to the transportable container 20 pulling the stretch wrap 54. As a result, less tearing of the stretch wrap 54 occurs and a more stable transportable container 20 is formed. The amount of the pre-stretching of the stretch wrap 54 may be controlled based on the type of bulk goods 22 being wrapped.

The stretch wrap 54 generates hoop forces which apply a gentle squeeze to the bulk goods 22, helping to stabilize the bulk goods 22. The hoop forces stabilize the bulk goods 22 by promoting controllable contact between the elements of the bulk goods 22 being loaded into the transportable container 20, thereby promoting bridging between the components of the bulk goods 22. For example, when the bulk goods 22 being loaded are a bulk cereal in puff or flake form, hoop forces promote bridging between cereal pieces, thereby reducing the relative motion between the pieces and immobilizing the cereal within the transportable container 20. By adjusting the extent to which the stretch wrap 54 is prestretched and applied to the transportable container 20, via pre-stretching force control, hoop forces can be tailored to the type of bulk goods 22 being inserted in the transportable container 20. Hoop forces allow for a very compact and rigid transportable container 20, which does not allow the bulk goods 22 to shift or get crushed within the transportable container 20.

Figure 11:
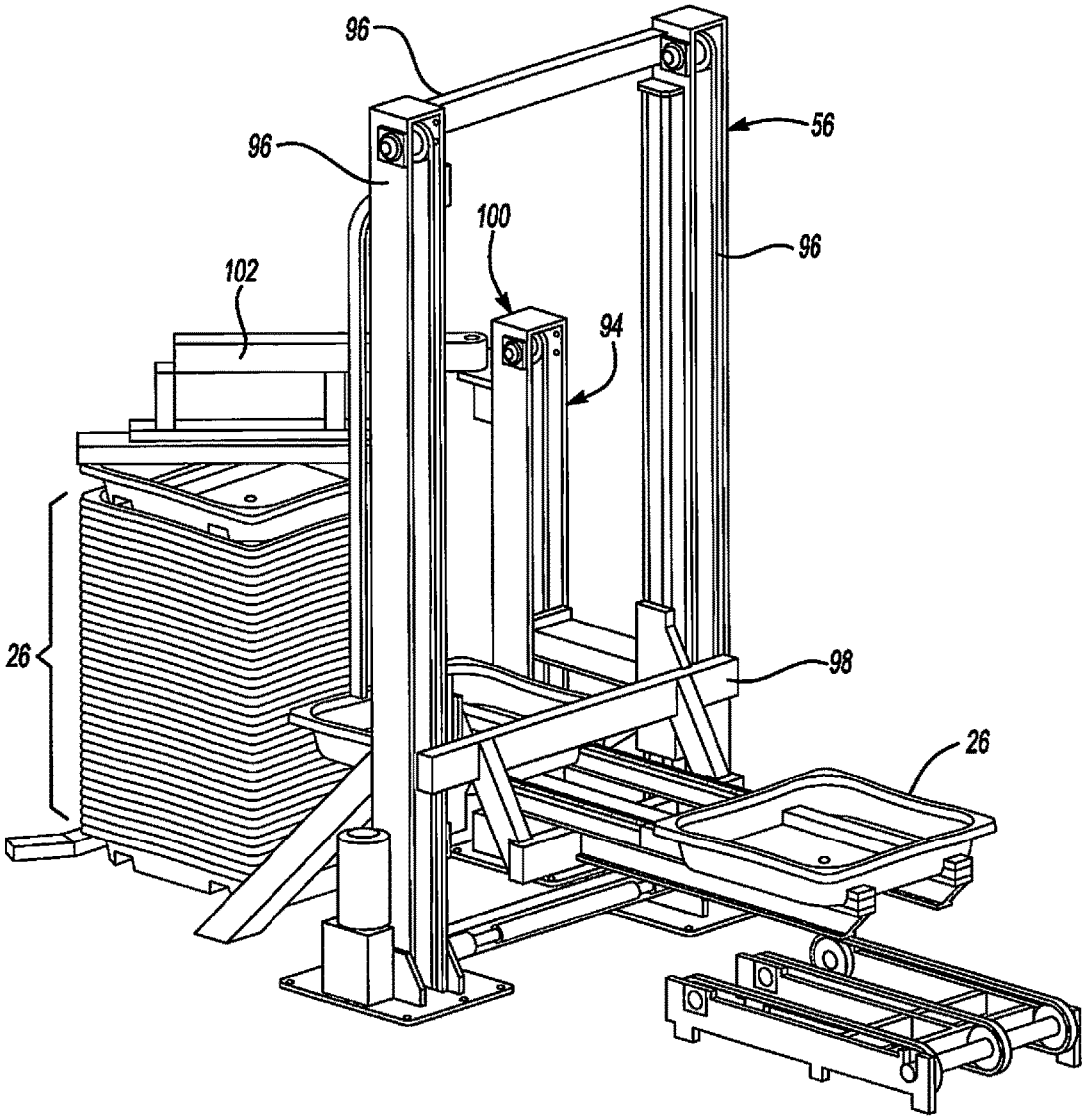
FIG. 11 is a perspective view of the transfer system in a lowered position according the subject invention.
Figure 12:
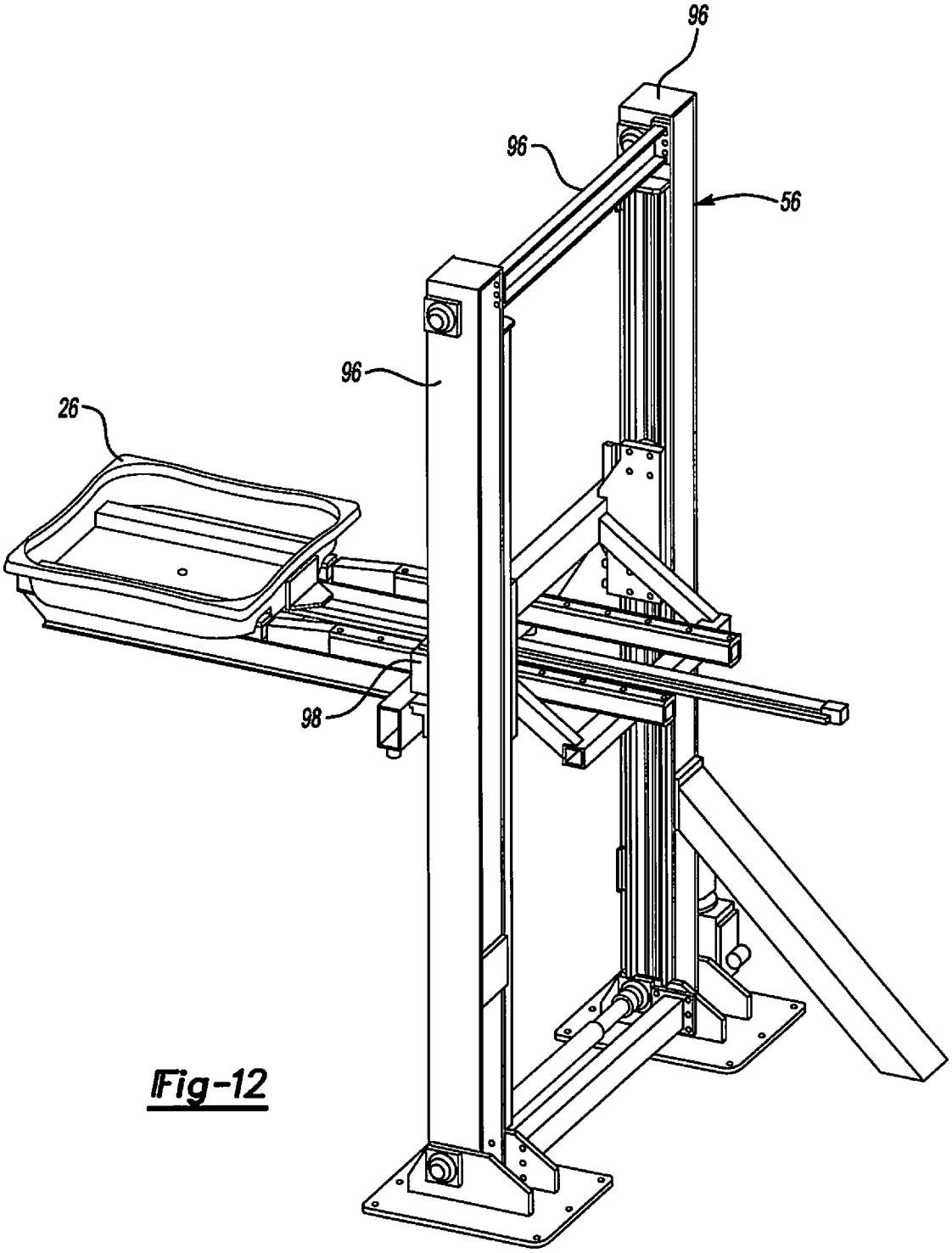
FIG. 12 is a perspective view of the transfer system in a raised position according the subject invention.

The packaging system 24 includes a lift mechanism 56, as shown in FIGS. 11 and 12, for lifting the bottom support 26 vertically upwardly and downwardly. The movement of the bottom support 26 can be accomplished by any of a variety of lift mechanisms 56 including, but not limited to, scissors platform legs 34, hydraulic pistons, pneumatic pistons, or a geared mechanism. Prior to receiving bulk goods 22, the lift mechanism 56 lifts the bottom support 26 to its initial upward position adjacent a slip frame former 58. As the level of bulk goods 22 increases in the transportable container 20 and the bottom support 26 is moved vertically downwardly by the lift mechanism 56 to accommodate additional bulk goods 22, the stretch wrap 54 is spirally wrapped by the rotary stretch wrapping device 30 at a predetermined level below the level of bulk goods 22 to form the transportable container 20.

The packaging system 24 further includes a transfer mechanism 60, as shown in FIG. 1, that is disposed adjacent the rotary stretch wrapping device 30, and more specifically it extends outwardly from between adjacent legs 34 of the frame 32. The transfer mechanism 60 allows for the transportable container 20 to be transferred away from the packaging system 24 after the transportable container 20 has been wrapped by the rotary stretch wrapping device 30. In the exemplary embodiment, the transfer mechanism 60 is a conveyor, but it may be any transfer mechanism 60 known in the art. After the rotary stretch wrapping device 30 has produced a transportable container 20 and the lift mechanism 56 is in its downward position, the transportable container 20 is transferred to the transfer mechanism 60 from the lift mechanism 56 so that the transportable container 20 may be moved away from the rotary stretch wrapping device 30, thus allowing the packaging system 24 to continuously produce transportable containers 20.

Figure 5:
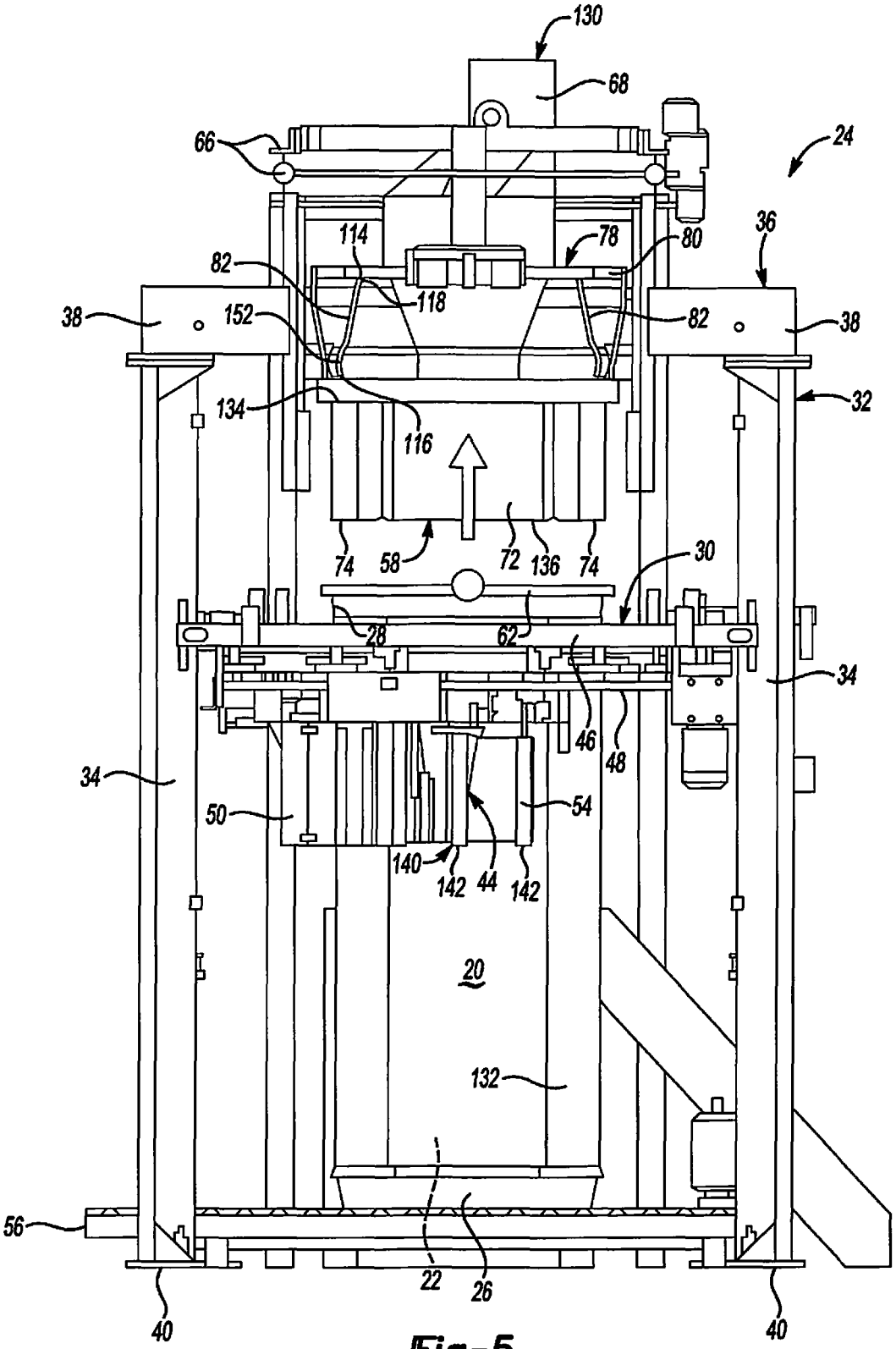
FIG. 5 is a partial side view of the packaging system showing the slip frame former, feed source and intermediate carrier being raised upwardly and the closure arm for closing the transportable container following the filling of the transportable container according the subject invention.

The packaging system 24 may further include a closure arm 62, as shown in FIG. 5, that after filling of the transportable container 20 sweeps across the top of the transportable container 20 to knock the open top 122 of the bag 28 to a side of the transportable container 20. The closure arm 62 may be secured to the support portion 46 of the rotary stretch wrapping device 30 and sweeps in a horizontal direction to position the open top 122 of the bag 28 in a folded over position for closing of the transportable container 20. Once the open top 122 of the bag 28 is in the folded over position, additional layer of stretch wrap 54 may be applied from the rotary stretch wrapping device 30 over the folded over bag 28 to seal and close the transportable container 20.

The packaging system 24 may further include a platform section 64, as shown in FIG. 1, that extends around a portion of the packaging system 24. The platform section 64 may include a series of levels and walkway portions around the packaging system 24. The platform section 64 may also include stairs or a ladder to gain access to the series of levels and walkway portions. The platform portion allows an operator to gain access to many of the components of the packaging system 24 for cleaning and maintenance of the components.

The packaging system 24 may further include a secondary frame 66 for positioning a slip frame former 58, gentle handling hopper 68, and intermediate carrier 78 relative to the rotary stretch wrapping device 30. The secondary frame 66 is disposed above the rotary stretch wrapping device 30 and intersects the frame 32 so that the slip frame former 58, gentle handling hopper 68, and intermediate carrier 78 can move horizontally and vertically relative to the rotary stretch wrapping device 30.

The packaging system 24 utilizes the slip frame former 58 to shape and form the transportable container 20. In the exemplary embodiment, the slip frame former 58 is secured to the secondary frame 66 by a plurality of former supports 144 that extend downwardly from the secondary frame 66, and is moveable both vertically and horizontally along the former supports 144 and secondary frame 66. The slip frame former 58 is positioned within the frame 32 of the rotary wrapping system and directly above the ring portion 48. In operation, the slip frame former 58 extends downwardly from the secondary frame 66 and former supports 144 and is centered in the rotary stretch wrapping device 30 such that the ring portion 48 is positioned about the slip frame former 58 to move vertically upwards and downwards about the slip frame former 58. The slip frame former 58 may be round, square or any other shape known in the art. The shape of the slip frame former 58 is chosen based on the desired shape of the transportable container 20.

Figure 9:
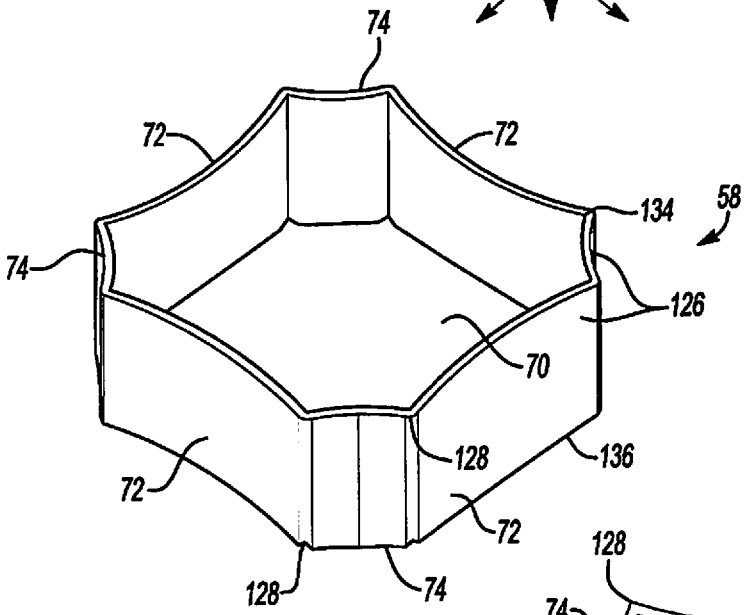
FIG. 9 is a perspective view of the slip frame former according to the subject invention.
Figure 10:
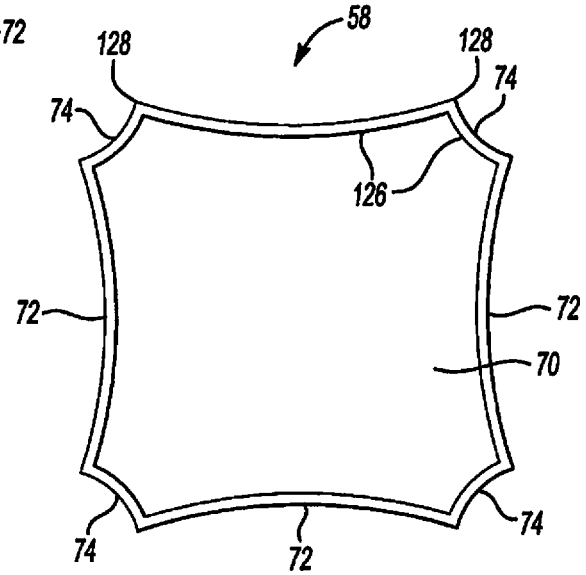
FIG. 10 is a top view of the slip frame former according to the subject invention.

In the exemplary embodiment, the slip frame former 58, as shown in FIGS. 9 and 10, includes at least one former wall 126 having an outer surface that defines a frame opening 70. The former walls 126 are from about 6 to 15 inches in height and may be made from metal, plastic, or any other material known in the art. The former walls 126 are configured such that the frame opening 70 is the desired shape in which the transportable container 20 will be formed into. In the exemplary embodiment, the former walls 126 have a continuous outer surface that extends from the former bottom 136 of the slip frame former 58 to the former top 134 of the slip frame former 58. When the slip frame former 58 is used in addition to a bottom support 26, the slip frame former 58 will be generally the same shape as the bottom support 26 so as to hold the desired shape of the bottom support 26. The slip frame former 58 may be a solid shape having former walls 126 or consist of a former base having former arms or fingers extending downwardly from the former base.

The stretch wrap 54 that is used to secure the transportable container 20 overlaps the outer surface of the slip frame former 58 so as to maintain the shape of the slip frame former 58. The outer surface of the slip frame former 58 may be altered to allow for the slip frame former 58 to be easily pulled away from the stretch wrap 54 as the level of bulk goods 22 in the transportable container 20 increases and the bottom support 26 is moved away from the slip frame former 58. The outer surface of the slip frame former 58, particularly the corners of the former walls 126 or the downwardly extending arms, may be altered by a Teflon coating, a dimpled surface, or any other method known in the art for decreasing the amount of friction between the slip frame former 58 and stretch wrap 54. In an alternative embodiment, the former walls 126 include a former base having arms that extend downwardly from the former base. This embodiment decreases the outer surface of the slip frame former 58 and decreases the amount of friction between the slip frame former 58 and the stretch wrap 54.

In the exemplary embodiment, the slip frame former 58, as shown in FIGS. 9 and 10, is octagonally shaped having four long wall portions 72 and four short wall portions 74, with each of the adjacent long wall portions 72 being connected by a short wall portion 74. Each of the four long wall portions 72 extend between ends and generally form a square, with each of the long wall portions 72 being spaced at adjacent ends. Each of the short wall portions 74 extend diagonally between adjacent ones of the ends of the long wall portions 72 to form a generally octagonally shaped slip frame former 58. The edges 128 where each of the long wall portions 72 engages a short wall portion 74 may be rounded to minimize the friction between the slip frame former 58 and stretch wrap 54 to allow the stretch wrap 54 to slide free from the slip frame former 58 during operation without tearing. In addition, each of the long wall portions 72 and short wall portions 74 may be concaved inward so that transportable container 20 formed has a straight side without any budge in the middle.

The slip frame former 58 also act as a force control mechanism, i.e., the wrap is applied to the slip frame former 58 as opposed to being applied directly to the product. As such, the slip frame former 58 reduces product damage that could result from the direct application of the stretch wrap 54 to the bulk goods 22 in the transportable container 20.

While the packaging system 24 could work with or without a bag 28, the exemplary embodiment includes a scrunched bag system 76 having an intermediate carrier 78 for holding a flexible bag 28 in an open and scrunched or bunched position. The bag 28 is held by the intermediate carrier 78 in a scrunched position by tension from the intermediate carrier 78 against the bag 28 and then released from the intermediate carrier 78 without mechanical interaction as the bag 28 is released and the transportable container 20 is formed.

The flexible bag 28 includes an open top 122 and a closed base 124 to form the transportable container 20 of bulk goods 22. The flexible bag 28 defines an open top 122 for receiving bulk goods 22. The closed base 124 can be formed into the bag 28 or the bag 28 can be a continuous tubular roll wherein the closed base 124 is formed by folding over the tube, bunching the tube up, or by twisting and tying off a length of the tube which later could be used as a pour spout during subsequent unloading of the bulk goods 22. The bag 28 is preferably a gusseted bag 28 and can be formed from any suitable material for the bulk goods 22 disposed in the bag 28 of the transportable container 20, such as for example, low density polyethylene, high density polyethylene, a food grade polymer, or nylon.

Figure 17:
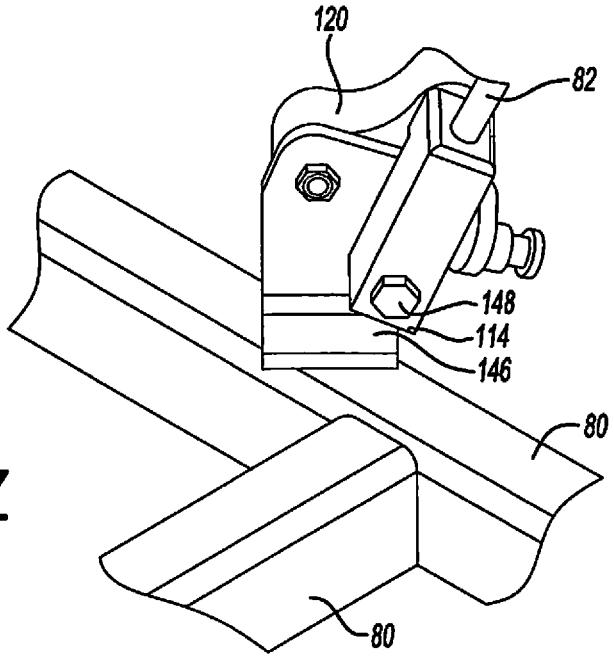
FIG. 17 is a partial perspective view of the pivotal connection of the intermediate carrier according to the subject invention.

In summary, the intermediate carrier 78, as shown in FIGS. 14-17, includes a rigid carrier base 80 that is disposed about a base axis $A_B$. A plurality of carrier arms 82 are pivotally connected to the carrier base 80 and extend between a first arm end 114 and a second arm end 116. Each of the carrier arms 82 extend outwardly, preferably angularly outwardly, from the carrier base 80 to hold the bag 28 in a scrunched position. Each of the carrier arms 82 are pivotally connected, via a pivotal connection 118, to the carrier base 80 at the first arm end 114 to pivot each of the carrier arms 82 at the first arm end 114 to allow the second arm end 116 to move radially inward and outward. The pivotal connection 118 may be any type of pivotal connection 118 known in the art. In the exemplary embodiment, as shown in FIG. 17, the pivotal connection 118 includes a bracket portion 146 secured to the carrier base 80, with the first arm end 114 being pivotally connected to the bracket portion 146 by a bolt or some other pivoting mechanism 148. An elastomeric joint 120 is disposed adjacent the pivotal connection 118 between each of the first arm ends 114 and the carrier base 80 to bias each of the second arm ends 116 radially outward. The biasing of the second arm ends 116 radially outward provides tension against the bag 28 from each of the second arm ends 116 to hold the bag 28 in the scrunched position.

The carrier base 80 of the intermediate carrier 78 is a food contact surface and is designed to be easy to clean and includes acceptable food contact materials. While the carrier base 80 may be any shape known in the art, including but not limited to, round, square and rectangular, the shape in the exemplary embodiment is U-shaped. The U-shaped carrier has an open end 150 to ease the maneuverability of the intermediate carrier 78 into and out of the packaging system 24. While the shape of the intermediate carrier 78 is open ended in the exemplary embodiment, it could be closed.

The intermediate carrier 78 includes a plurality of carrier arms 82. While at least three arms are required, any number of carrier arms 82 could be used. In the exemplary embodiment, the intermediate carrier 78 has four carrier arms 82. The carrier arms 82 are pivotally connected to the carrier base 80. The carrier arms 82 extend angularly from the carrier base 80 to the second arm end 116, and are biased radially outwardly to provide tension against the bag 28 disposed thereon. The carrier arms 82 of the intermediate carrier 78 are pivoted and biased to the carrier base 80 via an elastomeric joint 120, such as a silicon rubber joint, but may be pivoted and biased by any biasing mechanism known in the art.

Each of the second arm ends 116 may include a cap portion or a rounded portion 152 to assist with guiding the bag 28 onto the intermediate carrier 78. The second arm ends 116 create a plurality of contact points 138 between the intermediate carrier 78 and the bag 28. The plurality of contact points 138 maintain contact with the bag 28 to create an opening in the bag 28, and hold the bag 28 in its proper open position. The second arm ends 116 push outwardly against the inside surface of the flexible bag 28 creating tension on the bag 28 to secure the bag 28 onto the intermediate carrier 78. The biasing of the carrier arms 82 outwardly on the bag 28, allows the bag 28 to be held and released by the intermediate carrier 78 without puncturing the bag 28.

The intermediate carrier 78 may include at least one support arm 86 that extend from the carrier base 80. In the exemplary embodiment, the intermediate carrier 78 includes a plurality of support arms 86 that extend radially from the carrier base 80. The support arms 86 are used to engage the packaging system 24 and secure the intermediate carrier 78 to the packaging system 24. In addition, the support arms 86 provide a means for handling the carrier base 80. For example, the support arm 86 could allow an operator or machine to pick up and move the intermediate carrier 78 between an operating or in-use position and non-operating or non-use position.

The bag 28 used to create the transportable container 20 is fed onto the intermediate carrier 78. The bag 28 may be fed manually by an operator, automatically with a feeder, or a combination of manual and automatic. In the exemplary embodiment the bag 28 is fed manually by a human operator. In an alternative embodiment, a feeder is used to fed the bag 28 onto the intermediate carrier 78. The feeder may be independent of the packaging system 24. Prior to placement on the packaging system 24, the intermediate carrier 78 is placed onto the feeder. The open top 122 of the bag 28 is placed around the plurality of carrier arms 82. The feeder controls the flow of the bag 28 onto the intermediate carrier 78. The feeder may include plurality of rollers and/or belts to uniformly control the feed of the bag 28 onto the intermediate carrier 78. Uniformly feeding the bag 28 onto the intermediate carrier 78 allows for bag 28 to be uniformly dispersed from the intermediate carrier 78 when forming the transportable container 20. Uniform disbursement of the bag 28 from the intermediate carrier 78 is useful in maintaining a desired shape for the transportable container 20.

Figure 13:
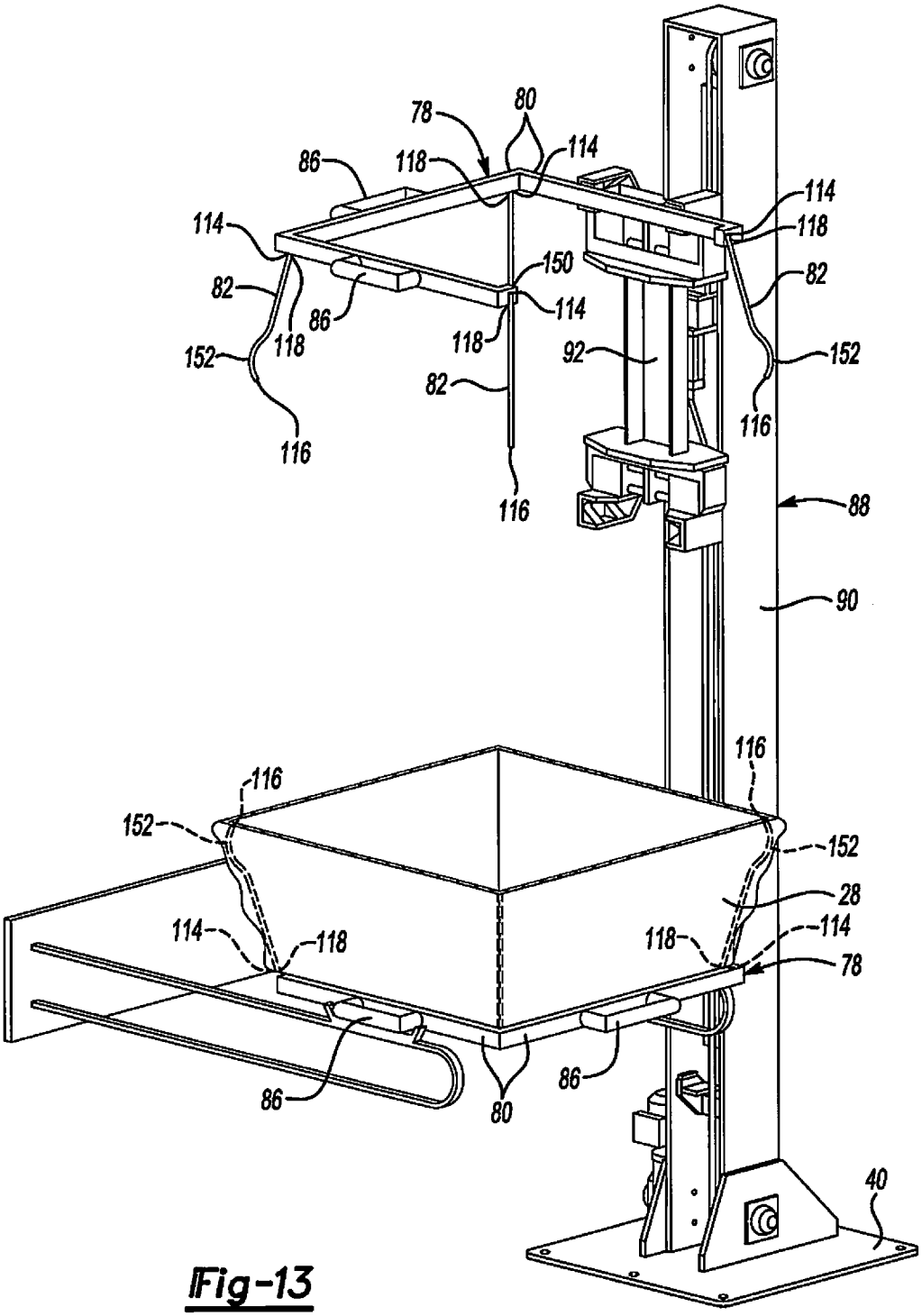
FIG. 13 is a perspective view of the carrier lift system according the subject invention.

Once the bag 28 is placed onto the intermediate carrier 78, the intermediate carrier 78 is transported to the packaging system 24. This can be done by a human operator, a robot or other mechanical means. In the exemplary embodiment, the intermediate carrier 78 is transported via a carrier lift system 88, as shown in FIG. 13.

The carrier lift system 88 of the present invention includes a lift leg 90 and a vertically movable lift arm 92. The lift arm 92 is rotatable on the lift leg 90 so as to be able to provide the function of removing an empty intermediate carrier 78 from the packaging system 24 and placing a loaded intermediate carrier 78 in its place. The lift arm 92 interacts with one of the support arms 86 extending from the intermediate carrier 78 to pick up and transfer the intermediate carrier 78.

In the exemplary embodiment, the intermediate carrier 78 is secured to the packaging system 24 such that the scrunched bag 28 disposed on the intermediate carrier 78 is placed through the frame opening 70 of the slip frame former 58. The open top 122 is disposed adjacent a feed source 130, and the closed base 124 of the bag 28 is placed adjacent the bottom support 26. The intermediate carrier 78 is secured to and moveable along the secondary frame 66 in both a vertical and horizontal direction. The secondary frame 66 maintains the position of the intermediate carrier 78 relative to the feed source 130.

As bulk goods 22 are added to the bag 28, the intermediate carrier 78 provides for a consistent release of the bag 28 as the bottom support 26 moves downwardly to accommodate additional bulk goods 22. The consistent release of the bag 28 is due to the equal pressure from the carrier arms 82 on the bag 28.

The transportable container 20 includes a bottom support 26 which forms the base of the transportable container 20. The bottom support 26 includes, but is not limited to a transporter base, slip sheet, pallet or any other bottom support 26 known in the art. The slip sheet is typically a folded sheet of cardboard, but may be any other material known in the art, including but not limited to plastic. The pallet may be wood, plastic or any other material known in the art. Typically, the pallet and the slip sheet are used together.

In the preferred embodiment, the bottom support 26 is a transporter base and begins the initial forming of the transportable container 20. The transporter base is made of molded plastic, but may be manufactured by any process known in the art and made of any other material known in the art. In an exemplary embodiment the transporter base is square, but the transporter base may be round or any other shape known in the art. A square transporter base is utilized to produce a square transportable container 20 while a round transporter base is utilized to produce a round transportable container 20. The square transporter base, which results in a square transportable container 20, is the preferred shape. The square transportable container 20 allows for the greatest amount of space to be utilized when a plurality of transportable containers 20 are placed next to one another in a shipping truck. The round transporter base, which results in a round transportable container 20, will lead to a void or wasted space being present when the round transportable containers 20 are placed next to one another in a shipping truck.

The transporter base initially forms the bulk goods 22 disposed in the transportable container 20 and further allows for the transportation of the transportable container 20. The transporter base includes a bottom and a wall extending peripherally from the bottom to a wall end. A plurality of ears extend radially outward from the wall end. The wall assists in the initial shaping of the transportable container 20.

The transporter base includes at least one pair of recesses that extend upwardly from the bottom of the transporter base so that the tines of a transporting device, such as a fork lift, can pick up and move the transportable container 20 of bulks goods. The transporter base may further include a plurality of inwardly extending notches so the bulk goods 22 will not conform directly to the inner surface of the transporter base, which may be problematic in removing the bulk goods 22 from the transporter base.

The packaging system 24 includes a transporter base transfer system 94. The transfer system 94 is disposed adjacent the rotary stretch wrapping device 30 of the packaging system 24. The transfer system 94 includes a brace portion 96 for supporting the transfer system 94, a lifting portion 98 and pick and place portion 100. The lifting portion 98 is vertically movable along the brace portion 96. The pick and place portion 100 includes a pick arm 102 for picking up the bottom support 26 and placing it on the lifting portion 98. The lifting portion 98 includes pairs of horizontally extending rails that are secured to the brace portion 96 to move upwardly and downwardly along the brace portion 96. A first end of the lifting portion 98 is disposed adjacent the pick and place portion 100 to receive a bottom support 26 from the pick and place portion 100. A second end of the lifting portion 98 is disposed within the frame 32 of the rotary stretch wrapping device 30 to place the bottom support 26 in a centered position within the frame 32 of the packaging system 24. In the exemplary embodiment, the lift mechanism 56 is incorporated into the transfer system 94. That is, the lifting portion 98 of the transfer system 94 acts as the lift mechanism 56 for lifting the bottom support 26 vertically upwardly and downwardly in operation.

Figure 8:
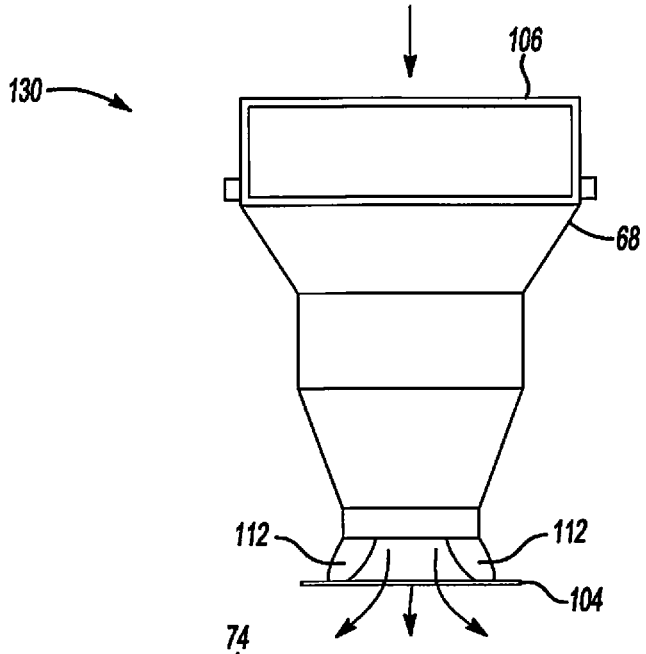
FIG. 8 is a front view showing the feed source in the form of a gentle handling hopper according the subject invention.

The packaging system 24 further includes at least one feed source 130, generally indicated, to introduce the bulk goods 22 into the transportable container 20. The feed source 130, as shown in FIG. 8, may include a hopper 68, conveyor, or any other source known in the art to feed bulk goods 22 into the transportable container 20. The feed source 130 may be a gentle handling hopper 68 for filling the bag 28 and creating the transportable container 20. In an exemplary embodiment, the gentle handling hopper 68 is disposed above the rotary stretch wrapping device 30 during operation. The hopper 68 may be supported and moveable, both vertically and horizontally, along the secondary frame 66. The hopper 68 minimizes the vertical drop of the bulk goods 22 into the bag 28 to minimize breakage of the bulk goods 22. The hopper 68 is positioned over the open top 122 of the bag 28 for feeding bulk goods 22 into the transportable container 20. In the exemplary embodiment, the hopper 68 is disposed between the rotary stretch wrapping device 30 and a feed source 130, such as, a conveyor to feed bulk goods 22 into the transportable container 20.

The hopper 68 is stationary during filling of the transportable container 20. The hopper 68 remains stationary as the bottom support 26 moves downwardly in response to the amount of the bulk goods 22 in the transportable container 20. During the initial stages of filling the bag 28, the bottom support 26 is placed at a position adjacent to the slip frame former 58 near the upper portion of the rotary stretch wrapping device 30. The closed base 124 of the bag 28 rests in the bottom support 26 that is placed on and movable with the lift mechanism 56 or the lifting portion 98 of the transfer system 94. The hopper 68 includes a hoop portion 104 that extends from a bottom end of the hopper 68 to push down on the bag 28 and assist in placing the bag 28 in contact with the bottom support 26. The hoop portion 104 is tubular and spaced from the bottom of the hopper 68 to create space between the bottom support 26 and the bottom of the hopper 68. As the bag 28 fills, the bottom support 26 along with the closed base 124 of the bag 28 are moved in a downward direction to accommodate additional bulk goods 22 from the stationary hopper 68. The weight of the bulk goods 22 will keep the closed base 124 of the bag 28 in the bottom support 26 as the bottom support 26 moves downwardly.

The hopper 68 includes a hopper opening 106 to receive the bulk goods 22 from a secondary feed source 130. In the exemplary embodiment, the secondary feed source 130 is a conveyor and the bulk goods 22 are fed from the conveyor end into the hopper opening 106. The hopper 68 includes a distributing end that is positioned over the open top 122 of the bag 28 at a predetermined distance above the level of bulk goods 22 for distributing goods.

The hopper 68 is operated by maintaining the bulk goods 22 at a relatively high level within the hopper 68. The bulk goods 22 do not have to fall far from the conveyor end into the hopper opening 106. The movement of the bulk goods 22 through the hopper 68 is controlled such that the bulk goods 22 fed from the distributing end of the hopper 68 into the transportable container 20 have a shorter distance to fall. The transportable container 20 breaks the fall of the bulk goods 22 from the conveyor end to the bag 28 into two short falls as opposed to one larger fall. The two shorter falls minimizes the breakage of the bulk goods 22.

The hopper 68 may include a modulating valve disposed at the distributing end to adjust the flow of the bulk goods 22 from the hopper 68 into the transportable container 20. A cone, plate, or screw may also be used to adjust the flow of the bulk goods 22 from the hopper 68. The modulating valve moves closer to and further away from a valve seat to keep the level of the bulk goods 22 at a desired level within the hopper 68. The modulating valve may further be rotatable based the bulk goods 22 being distributed from the distribution end of the hopper 68. If the level of bulk goods 22 within the hopper 68 is above the desired level the top hat valve will move away from the valve seat to distribute the bulk goods 22 to the transportable container 20 at an increased rate thus lowering the level of the bulk goods 22 in the hopper 68 such that the bulk goods 22 will not spill out of the hopper opening 106. If the level of bulk goods 22 within the hopper 68 is below the desired level the top hat valve will move towards the valve seat to distribute the bulk goods 22 into the transportable container 20 at a decreased rate thus the raising the level of the bulk goods 22 in the hopper 68 to minimize the distance the bulk goods 22 must fall from the feed source 130. As a result, the bulk goods 22 fall a shorter distance from the feed source 130 into the hopper 68 and gently and gradually travel to the distributing end of the hopper 68 to be distributed into the transportable container 20 to form the transportable container 20. Additionally, the valve helps distribute the bulk goods 22 within the transportable container 20 to maintain an even fill and to have a flat top, thus increasing the amount of bulk goods 22 in the transportable container 20.

The modulating valve may further include a bulk goods distributor 112. In the exemplary embodiment, the bulk goods distributor 112 is at least one chute, fin or wing that aids in the distribution or preferential flow of the bulk goods 22 from the distributing end of the hopper 68, but the bulk goods distributor 112 may be any mechanism known in the art of preferential flow of bulk goods 22. The bulk goods distributor 112 may be flat, can include side walls, be rounded, or any other configuration based on the desired flow and the type of bulk goods 22 being distributed. The bulk goods distributor 112 may be incorporated into the design of the modulating valve or it may be a separate and distinct unit that can be attached to the modulating valve. The bulk goods distributor 112 allows for distribution of bulks goods to desired locations, particularly the corners of the transportable container 20, which aids in the forming of square or rectangular shaped transportable containers 20. The bulk goods distributor 112 allows for more flow of bulk goods 22 to the corners of the square or rectangular transportable container 20 to improve stability and shape consistency of the square or rectangular loads. The bulk goods distributor 112 allows for the flow of bulk goods 22 from the distributing end of the hopper 68 to be controlled and directed to desired portions of the transportable container 20 to aid in the shaping and optimal filling of the transportable container 20.

The hopper 68 may include a sensor to measure the hopper fill level of bulk goods 22 in the hopper 68. The sensor is in communication with the modulating valve to control the rate of distribution of the bulk goods 22 and the hopper fill level in the hopper 68. The sensor monitors the amount of bulk goods 22 in the hopper 68 and regulates the modulating valve, cone, plate, or screw to maintain the bulk goods 22 height or hopper fill level in the hopper 68.

Figure 2:
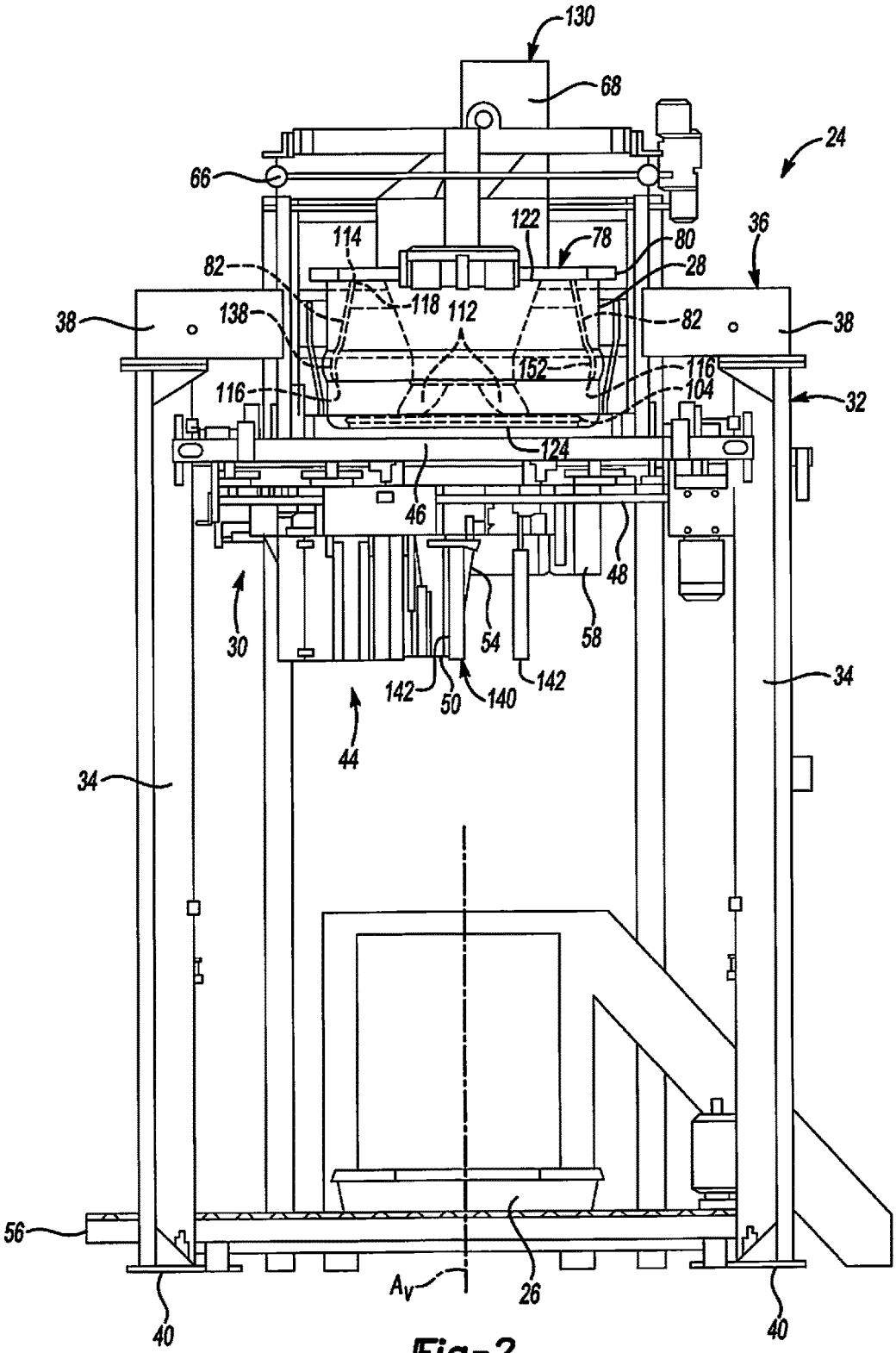
FIG. 2 is a partial side view of the packaging system showing the bottom support prior to being raised to its initial position adjacent slip frame former for filling of the transportable container according the subject invention.

In summary, a transportable container 20 of bulk goods 22 is formed from the packaging system 24. To begin the bottom support 26 is placed onto the lift mechanism 56 or the lift arm 92 of the transfer device, as shown in FIG. 2. This is done using the transfer system 94 where a pick arm 102 is used to place the bottom support 26 on to the lifting portion 98 of the transfer system 94. Once placed on the lifting portion 98, the bottom support 26 is moved, as shown in FIG. 3, horizontally along the lifting portion 98 to a position vertically below the slip frame former 58.

The transportable container 20 may be formed with or without a bag 28. When a bag 28 is included, the bag 28 having an open top 122 and closed base 124 that has been bunched and placed onto the intermediate carrier 78 is transferred from the feed station to the secondary frame 66 using the carrier lift system 88. The intermediate carrier 78 is secured to the secondary frame 66 with the open top 122 being adjacent the feed source 130. The secondary frame 66 moves the hopper 68 and intermediate carrier 78 to a position that is above the rotary stretch wrapping device 30, with the open top 122 of the bag 28 being disposed adjacent the feed source 130 and the closed base 124 of the bag 28 being positioned vertically below the open top 122. The bottom of the intermediate carrier 78 is placed through the frame opening 70 of the slip frame former 58 and adjacent the bottom support 26. The feed source 130 is placed over the bag 28 to create a vertical space between the distributing end and closed base 124. The hoop portion 104 of the hopper 68 that extends from the end of the hopper 68 pushes downward on the bag 28 to place the bag 28 in contact with the bottom support 26. The intermediate carrier 78 is secured to the secondary frame 66 relative to the feed source 130, and the closed base 124 of the bag 28 is disposed in the bottom support 26, which is placed onto the lift mechanism 56.

The bulk goods 22 are dispensed from the feed source 130, in the exemplary embodiment, the distributing end of the hopper 68 through the open top 122 of the bag 28 into the closed base 124 of the bag 28 to establish a level of bulk goods 22 in the bag 28. The feed source 130 remains stationary during the dispensing step to maintain the vertical space between the feed source 130 and the level of bulk goods 22 in the bag 28 or transportable container 20.

Figure 3:
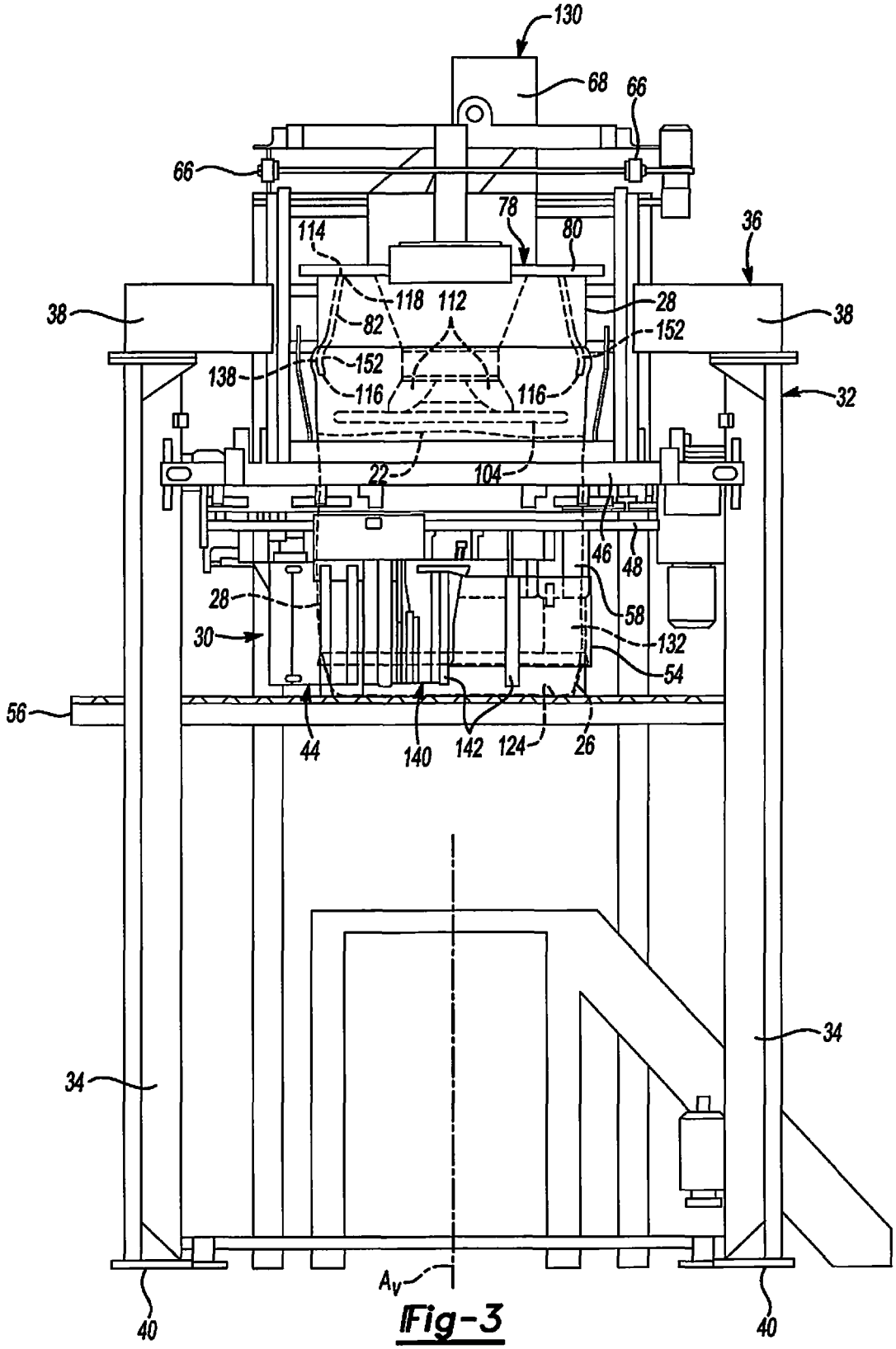
FIG. 3 is a partial side view of the packaging system showing the bottom support positioned relative to the slip frame former with the stretch wrap being applied as the transportable container is filled according the subject invention.
Figure 4:
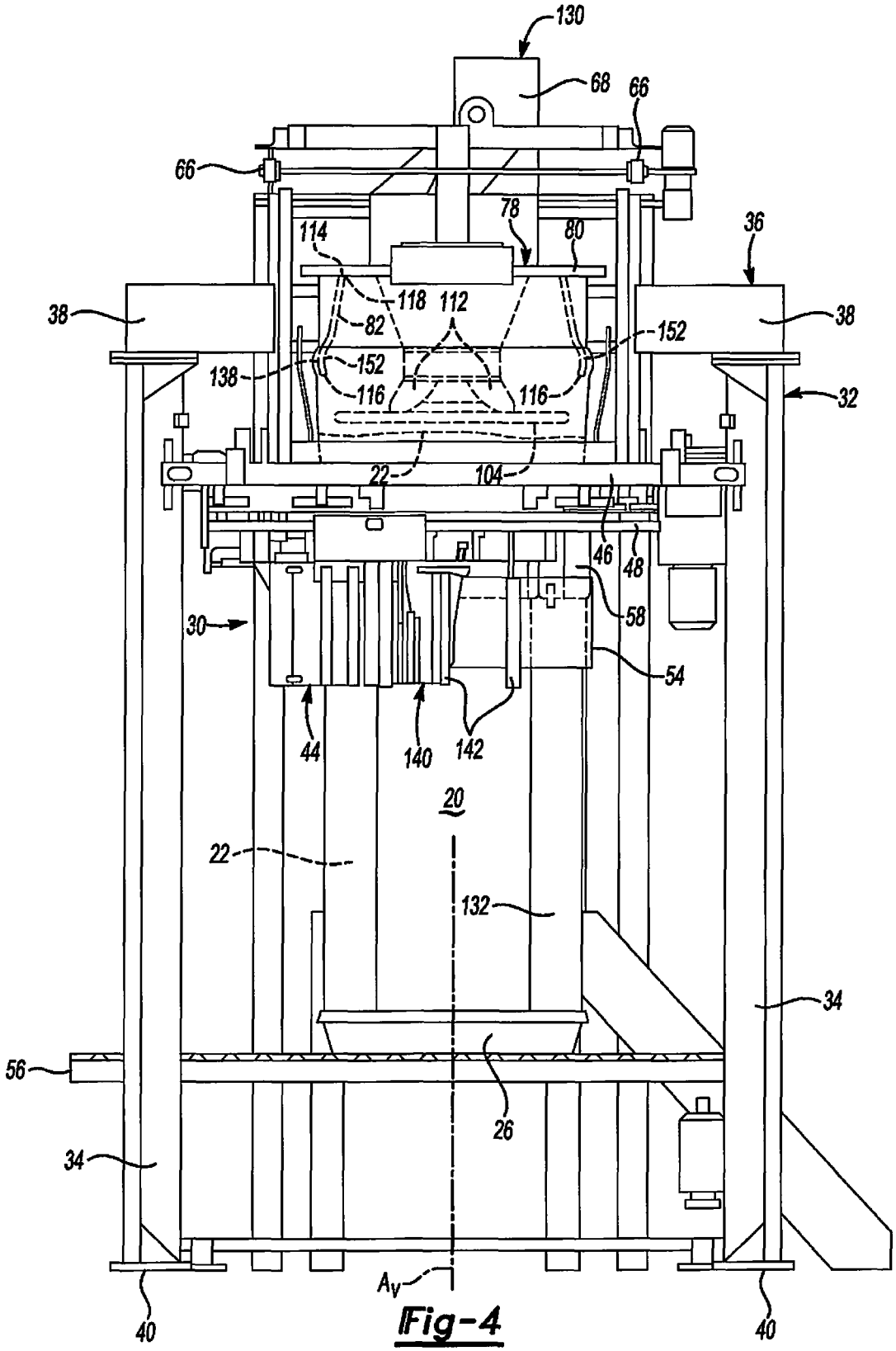
FIG. 4 is a partial side view of the packaging system showing the bottom support moving downwardly relative to the slip frame former during the filling of the transportable container according the subject invention.

As shown in FIGS. 3 and 4, the stretch wrap 54 from the stretch wrapping device 30 is disposed radially about the non-rotating bottom support 26 and a portion of the at least one former wall 126 of the non-rotating slip frame former 58 to initially form the transportable container 20. This can be done prior to, simultaneously with, or following the introduction of bulk goods 22 from the feed source 130 into the transportable container 20.

During filling, as shown in FIG. 4, the closed base 124 of the bag 28 moves relative to the intermediate carrier 78 to distribute the bag 28 from the intermediate carrier 78 as the amount of bulk goods 22 in the bag 28 increases. In the exemplary embodiment, the closed base 124 of the bag 28 moves downwardly with the bottom support 26 from the stationary intermediate carrier 78 as the amount of the bulk goods 22 in the transportable container 20 increases.

In addition, the bottom support 26 is moved vertically downwardly relative to the stationary slip frame former 58 in response to the amount of the bulk goods 22 in the transportable container 20. With the bottom support 26 in the raised position and adjacent the slip frame former 58, the stretch wrap 54 from the rotary stretch wrapping device 30 is wrapped around the bottom support 26 and the slip frame former 58 to initially form the transportable container 20. As the transportable container 20 disposed on the bottom support 26 is filled, the bottom support 26 is moved in a downward direction to accommodate additional bulk goods 22 in the transportable container 20. The rotary stretch wrapping device 30 maintains its vertical position during filling of the transportable container 20 and continuously applies layers of stretch wrap 54 to the slip frame former 58. The bottom support 26 moves downwardly relative to the slip frame former 58 to disengage the previously disposed portions of the stretch wrap 54 from the slip frame former 58 as the amount of bulk goods 22 increases in the transportable container 20 and additional layers of stretch wrap 54 are applied.

The movement of the bottom support 26 downward is controlled based on the amount of bulk goods 22 in the transportable container 20. The movement can be controlled in response to the weight of the bulk goods 22 in the transportable container 20 as determined by a scale, in response level of bulk goods 22 in the transportable container 20 as determined by a sensor, or a combination of weight and fill level. In the preferred embodiment, the movement of the bottom support 26 downward is based on the weight of the bulk goods 22 in the transportable container 20 in the initial stages of filling. Once the level of bulk goods 22 has reached a level where a sensor can detect the level of bulk goods 22 in the container, the movement of the bottom support 26 in the downward direction is controlled via a sensor that measures the level of bulk goods 22 in the transportable container 20.

The slip frame former 58 retains its position relative to the level of bulk goods 22 in the transportable container 20 as the amount of bulk goods 22 increases during filling of the bag 28 to form the transportable container 20. The slip frame former 58 is secured adjacent the upper support 36 of the rotary stretch wrapping device 30 and remains stationary as the bottom support 26 move vertically downward. As the bag 28 fills, the bottom support 26 is moved in a downward direction to accommodate additional bulk goods 22 and as such, the level of bulk goods 22 remains constant relative to the slip frame 32. This level of bulk goods 22 may top out within the slip frame former 58 or it may top out above the top of the slip frame former 58, as shown in FIG. 4.

Consistent low building force on the product created by slip frame former 58 and bulk goods 22 own weight allows the bulk goods 22 to settle into the shape of the slip frame former 58 and compact tightly. As more bulk goods 22 build up on top of bulk goods 22 in the transportable container 20, the bulk goods 22 move and fill the voids and the force on the bulk goods 22 slowly increases and is shared by all the bulk goods 22. In the preferred embodiment, the level of bulk goods 22 tops out above the former top 134 of the slip frame former 58 to create a head to allow for settling and a more compact unit, less voids, and more bulk goods 22 within the transportable container 20. Less breakage occurs due to less voids.

The film dispenser 50, which is mounted on the ring portion 48 and supported by the support portion 46 of the vertically moveable wrapping portion 44, rotates about a vertical axis $A_v$ as the vertically moveable wrapping portion 44 spirally wraps the stretch wrap 54 about the transportable container 20. During filling, the film dispenser 50 maintains its vertical position along the frame 32 of the rotary stretch wrapping device 30. The stretch wrap 54 that is used to secure the transportable container 20 overlaps the outer surface of the slip frame former 58 so as to maintain the shape of the slip frame former 58. As the amount of bulk goods 22 in the transportable container 20 increases and the bottom support 26 moves downwardly away from the slip frame former 58, the previously disposed layer of stretch wrap 54 disengage the slip frame former 58 as new layers of stretch wrap 54 are applied to the slip frame former 58. The outer surface of the slip frame former 58 may be altered to allow for the slip frame former 58 to be easily pulled away from the stretch wrap 54 as the level of bulk goods 22 in the transportable container 20 increases and the bottom support 26 is moved away from the slip frame former 58.

Once the transportable container 20 has been formed. Additional layers of stretch wrap 54 may be applied to the transportable container 20 to provide additional support. In the exemplary embodiment, the addition layers of stretch wrap 54 could be applied in a crisscross pattern. That is, the stretch wrap 54 is applied to the transportable container 20 at a bottom corner adjacent the bottom support 26 and extend to a top corner adjacent the top of the transportable container 20 on an opposite side of the transportable container 20. This can be repeated a plurality of times starting from different bottom corners to create the crisscross pattern of stretch wrap 54 on the transportable container 20.

In an alternative embodiment the former walls 126 of the slip frame former 58 may move radially inward and outward as the bottom support 26 moves downwardly from the slip frame former 58 to form the transportable container 20. The radial position of the slip frame former 58 may be adjusted radially to modify the shape of the transportable container 20. The radial movement of the former walls 126 of the slip frame former 58 may be controlled by hydraulic pistons, pneumatic pistons, a geared mechanism or any other method known in the art. In the exemplary embodiment, slip frame former 58 is segmented or made of fingers or rods. Each segment is movable independently or on a linkage such that when a command is received to move the slip frame former 58 radially inward or outward, the segments move in two directions, thus enabling the sides to move closer together or farther apart. This motion is controlled based on the particular shape desired. The radial movement of the slip frame former 58 results in the transportable container 20 having a shape that varies radially in vertical relationship to the bottom support 26. For example, the shape of the transportable container 20 could be hour glass shaped, tapered, pumpkin shaped or any other desired shape known in the art. In addition, the radial movement of the slip frame former 58, as the amount of bulk goods 22 increases, provides the benefit of increasing the effective hoop force on the bulk goods 22 that are more difficult to lock up, resulting in a transportable container 20 having a corrugated shape in vertical relationship to the bottom support 26.

The transportable container 20 can be closed or left open depending on bulk goods 22. For example, certain bulk goods 22 such as wood chips, sand, gravel, and other bulk goods 22, may not require that transportable container 20 be closed. In such instances, the stretch wrap 54 would be applied around the bulk goods 22 to secure the bulk goods 22 and create the transportable container 20. Alternatively, the transportable container 20 may be closed in any of a variety of manners known in the art including, but not limited to: sonic or heat welding of the top of the transportable container 20, closure of the top of the transportable container 20 with a plastic pull tie, closure of the top of the transportable container 20 with wire or rope, closure of the top of the transportable container 20 with a clamp, and other closure means known in the art.

Figure 6:
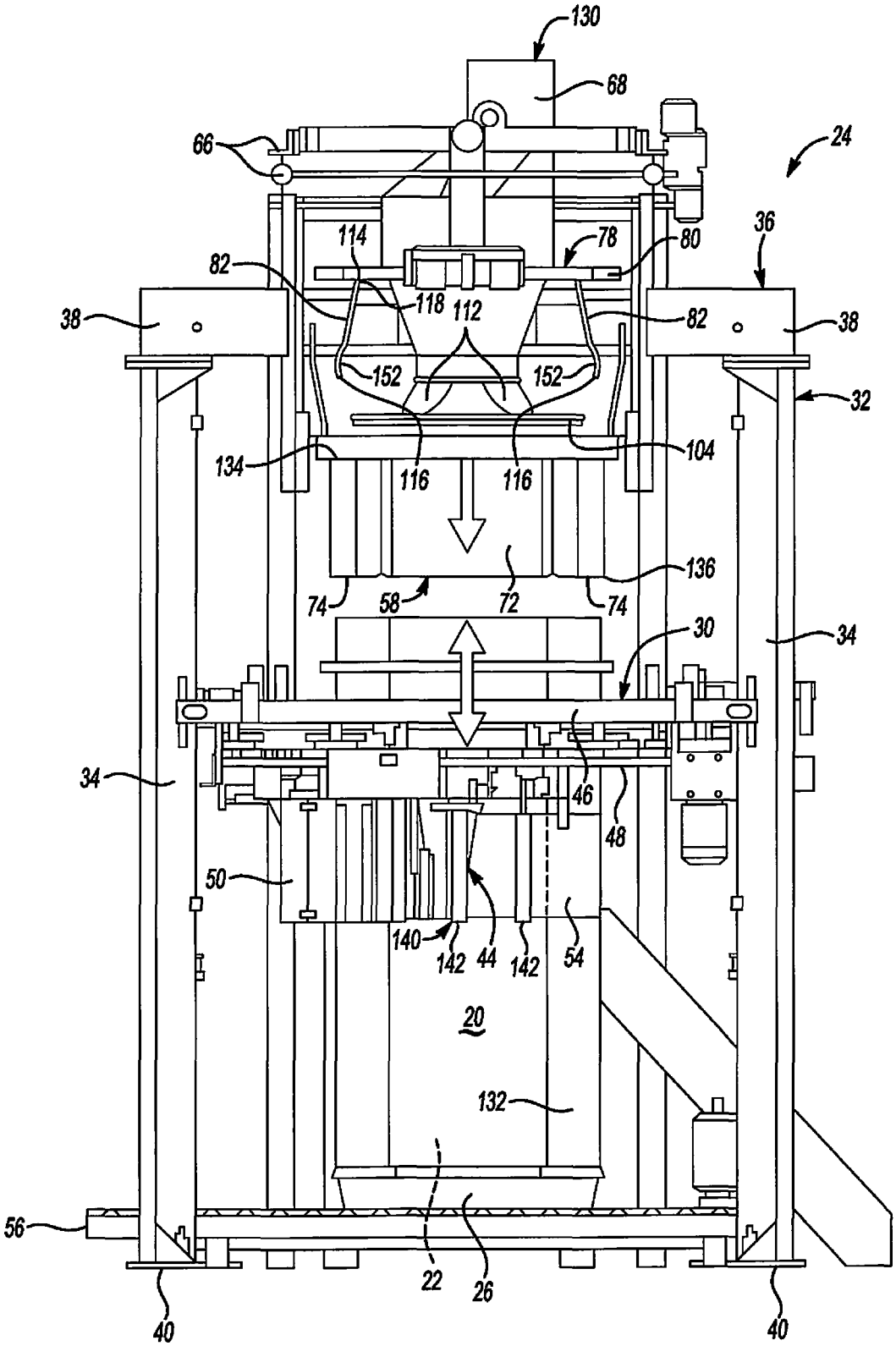
FIG. 6 is a partial side view of the packaging system showing the slip frame former, feed source and intermediate carrier being raised following the filling of the transportable container and the film dispenser being lowered to allow the closure arm to fold over the bag according the subject invention.
Figure 7:
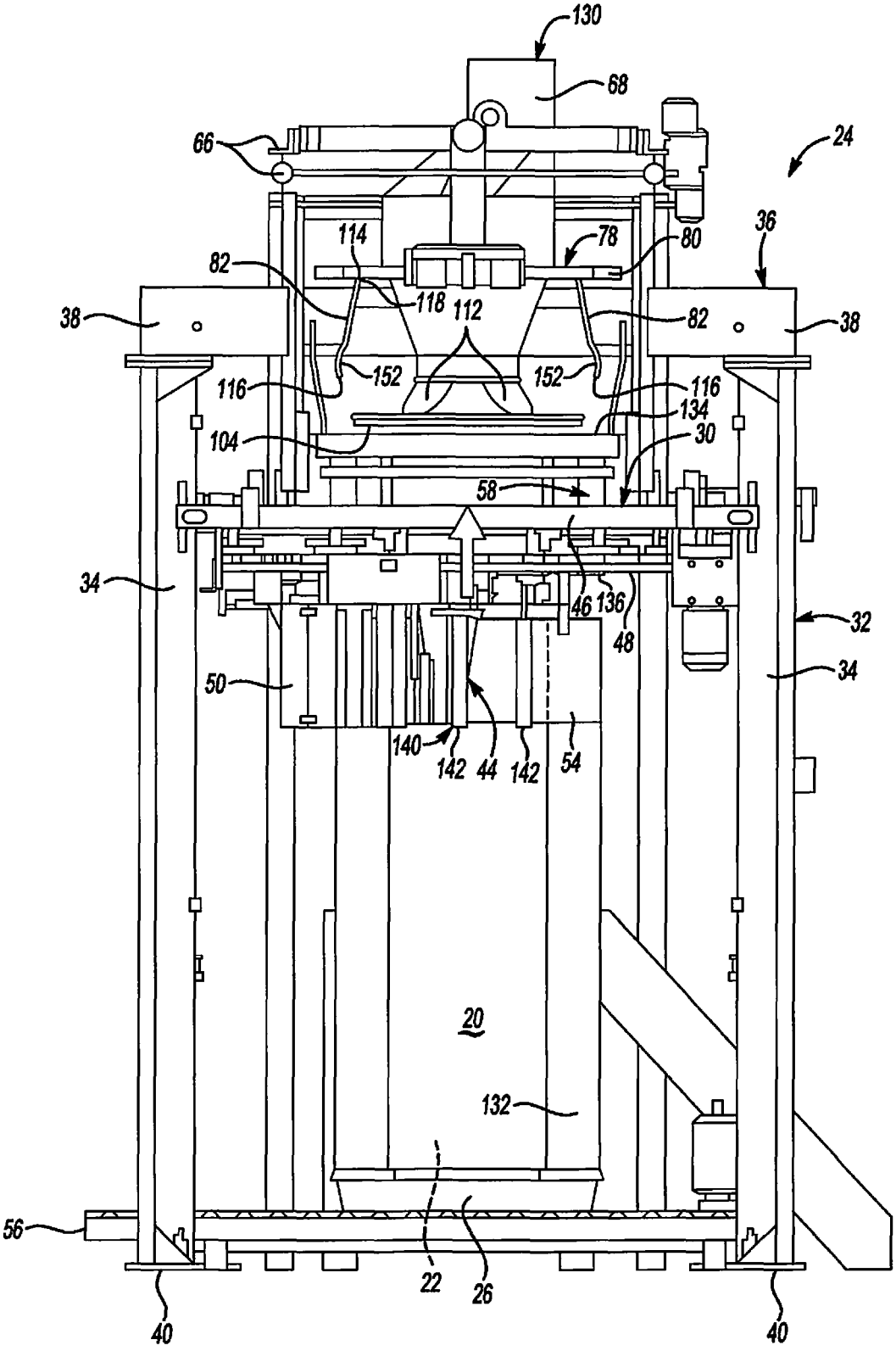
FIG. 7 is a partial side view of the packaging system showing the film dispenser being raised to close the transportable container with stretch wrap according the subject invention.

In the exemplary embodiment, as shown in FIG. 5, the packaging system 24 includes a closure arm 62 that after filling of the transportable container 20 sweeps across the top of the transportable container 20 to knock the open top 122 of the bag 28 to a side of the transportable container 20. As shown in FIGS. 6 and 7, once the open top 122 of the bag 28 is in a folded over position, additional layer of stretch wrap 54 are applied from the rotary stretch wrapping device 30 over the folded over bag 28. In the exemplary embodiment, the closure arm 62 is secured to the support portion 46 of the rotary stretch wrapping device 30 and sweeps in a horizontal direction to position the open top 122 of the bag 28 in the folded over position for closing of the transportable container 20.

The packaging system 24 preferably includes a control panel to permit an operator to control various functions, including, but not limited to, stop, start, filling dispenser speed, hopper 68 fill speed and interaction among the various components of the packaging system 24. Such controls are known in the art. The packaging system 24 further includes conventional controls to maintain proper fill level, stretch wrap force, pre-stretching of the stretch wrap 54, and sequencing. The relationship of these parameters is constantly monitored and automatically adjusted by means known in the art. The hopper 68 and feed source 130 may be in communication with the fill sensor of the packaging system 24 that monitors the level of bulk goods 22 in the bag 28 of the transportable container 20 via the control panel. For example, the fill sensor may communicate with the hopper 68 to control, by shutting off or turning on, the flow of bulk goods 22 from the distributing end of the hopper 68. Further, the fill sensor may communicate with the feed source 130 to control, by shutting off or turning on, the flow of bulk goods 22 from the feed source 130 into the hopper 68.

In summary, the present invention provides for a method of producing a transportable container 20 for supporting bulk goods 22. The method begins by positioning a non-rotating slip frame former 58 adjacent a non-rotating bottom support 26. The slip frame former 58 surrounds a portion of the transportable container 20 and defines a frame opening 70 for receiving the bulk goods 22 from a feed source 130. A stretch wrap 54, disposed from a rotary stretch wrapping device 30, is prestretched from a non-stretched state to a stretched state prior to being disposed from the rotary stretch wrapping device 30 to the transportable container 20. To initially form the transportable container 20, the rotary stretch wrapping device 30 is rotated radially about the non-rotating slip frame former 58 and non-rotating bottom support 26 to dispose the stretch wrap 54 in the stretched state radially about the bottom support 26 and a portion of the slip frame former 58. Next, the transportable container 20 is filled with bulk goods 22 from the feed source 130 through the frame opening 70. At least one of the slip frame former 58 and the bottom support 26 are vertically moved relative to other in response to the fill level of the bulk goods 22 in the transportable container 20. The slip frame former 58 and the bottom support 26 are vertically moved relative to other to expose the filled portion 132 of the transportable container 20 therebetween, as the transportable container 20 is filled with bulk goods 22. In the exemplary embodiment, the bottom support 26 of the transportable container 20 lowers as the transportable container 20 is filled and formed. The vertical movement of the bottom support 26 downward is controlled based on the amount of bulk goods 22 in the transportable container 20. The slip frame former 58 is maintained in a position to surround the bulk goods 22 in the transportable container 20. Previously disposed portions of the stretch wrap 54 are disengaged from the slip frame former 58 to allow the stretch wrap 54 to return to the non-stretched state and squeeze the filled portion 132 of the transportable container 20 and lock together the bulk goods 22 disposed therein as at least one of the slip frame former 58 and the bottom support 26 moves relative to other.

The present invention further provides for a method of optimally packaging a transportable container 20 of bulk goods 22. The method begins by placing a bag 28 with an open top 122 and a closed base 124 through a frame opening 70 defined by a slip frame former 58. The slip frame former 58 includes at least one wall that extends between a former top 134 and a former bottom 136. The slip frame former 58 surrounds a portion of the bag 28 with the closed base 124 of the bag 28 being disposed adjacent a bottom support 26 and the open top 122 of the bag 28 being vertically spaced from the closed base 124 and disposed adjacent a feed source 130. A stretch wrap 54 is disposed from a stretch wrapping device 30 radially about the bottom support 26 and a portion of the slip frame former 58 to initially form the transportable container 20. A fill level of bulk goods 22 is established in the bag 28 vertically above the former top 134 of the slip frame former 58. At least one of the slip frame former 58 and the bottom support 26 are vertically moved relative to other in response to the fill level of the bulk goods 22 in the bag 28 to expose the filled portion 132 of the bag 28 therebetween as the bag 28 is filled with bulk goods 22. In the preferred embodiment, the bottom support 26 of the transportable container 20 lowers as the transportable container 20 is filled and formed. The vertical movement of the bottom support 26 downward is controlled based on the amount of bulk goods 22 in the transportable container 20. The former top 134 of the slip frame former 58 is maintained in a position below the fill level of the bulk goods 22 in the bag 28. Additional portions of stretch wrap 54 are disposed around a portion of the at least one wall of the slip frame former 58 to maintain the transportable container 20 for receiving bulk goods 22 as previously disposed portions of stretch wrap 54 disengage the slip frame former 58 during the vertically moving step. The fill level of bulk goods 22 is maintained vertically above the former top 134 of the slip frame former 58 during the vertically moving step to create a head of bulk goods 22 during the forming of the transportable container 20. The head of bulk goods 22 allows for settling of the bulk goods 22 in the transportable container 20 and aids in the shaping and optimal filling of the transportable container 20. The fill level of bulk goods 22 further allows for a more compact transportable container 20 with less voids between the bulk goods 22 and more bulk goods 22 disposed within the transportable container 20.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. An intermediate carrier device for holding a scrunched bag having an open end and a closed base and forming a transportable container to support a plurality of bulk goods comprising:

a rigid carrier base disposed about a base axis;

a plurality of carrier arms disposed about the base axis and being pivotally connected to said carrier base by a pivotal connection and extending between a first arm end and a second arm end, each of said carrier arms extending from said carrier base for holding the bag in a scrunched position, and wherein each of said carrier arms are pivotally connected by said pivotal connection to said carrier base at said first arm end for pivoting each of said carrier arms at said first arm end to allow said second arm end to move radially inward and outward; and an elastomeric joint disposed adjacent said pivotal connection between each of said first arm ends and said carrier base for biasing each of said second arm ends radially outward away from said base axis to provide tension against the bag from each of said second arm ends and hold the bag in the scrunched position.

2. The intermediate carrier device as set forth in claim 1 wherein each of said carrier arms extend angularly outward from said carrier base for holding the bag in a scrunched position.

3. The intermediate carrier device as set forth in claim 1 wherein said carrier base is U-shaped and includes an open end for movement of the intermediate carrier device between an in-use position and a non-use position.

4. The intermediate carrier device as set forth in claim 1 wherein said elastomeric joint is a silicon rubber joint.

5. The intermediate carrier device as set forth in claim 1 wherein each of said second arm ends are rounded for assisting in the placement of the bag onto the intermediate carrier device and for creating a plurality of contact points between the intermediate carrier device and the bag.

6. The intermediate carrier device as set forth in claim 1 further including the bag having the open end and the closed base, with said bag being disposed about and in contact with each of the carrier arms for being held in the scrunched position.

7. The intermediate carrier device as set forth in claim 1 further including at least one support arm that extends from said carrier base for engaging a packaging system and securing the intermediate carrier device on the packaging system.

8. The intermediate carrier device as set forth in claim 1, wherein the carrier base includes a first portion disposed on a first side of the base axis, a second portion disposed on a second side of the base axis, and a third portion disposed on a third side of the base axis, wherein the carrier base defines an opening on a fourth side of the base axis, and wherein the first side is opposite the third side, and the second side is opposite the fourth side.

9. The intermediate carrier device as set forth in claim 8, wherein the pivotal connection of a first carrier arm of the plurality of carrier arms is disposed between the first side of the base axis and the second side of the base axis, the pivotal connection of a second carrier arm of the plurality of carrier arms is disposed between the second side of the base axis and the third side of the base axis, the pivotal connection of a third carrier arm of the plurality of carrier arms is disposed between third side of the base axis and the fourth side of the base axis, and the pivotal connection of a fourth carrier arm of the plurality of carrier arms is disposed between the fourth side of the base axis and the first side of the base axis.

10. The intermediate carrier device as set forth in claim 1, wherein the plurality of carrier arms include a first carrier arm and a second carrier arm, the first carrier arm pivotally connected to said carrier base by a first pivotal connection for rotation about a first axis of rotation, the second carrier arm pivotally connected to said carrier base by a second pivotal connection for rotation about a second axis of rotation, the second axis of rotation being transverse to the first axis rotation.

11. An intermediate carrier device for holding a scrunched bag having an open end and a closed base and forming a transportable container to support a plurality of bulk goods, the carrier device comprising:

a rigid carrier base disposed about a base axis;

a plurality of carrier arms disposed about said base axis and extending from said carrier base for holding the bag in a scrunched position, each carrier arm including a first arm end and a second arm end, the first arm end of each of said carrier arms pivotally coupled to said carrier base, the second arm end of said each carrier arm configured to move radially inward and outward relative to said base axis; and a joint coupling said first arm end of said each carrier arm to said carrier base and configured to bias the second arm end of said each carrier arm radially outward away from said base axis said base axis to provide tension against the bag from each of said second arm ends and hold the bag in the scrunched position.

12. The intermediate carrier device as set forth in claim 11 wherein each of said carrier arms extend angularly outward from said carrier base for holding the bag in a scrunched position.

13. The intermediate carrier device as set forth in claim 11 wherein said carrier base is U-shaped and includes an open end for movement of the intermediate carrier device between an in-use position and a non-use position.

14. The intermediate carrier device as set forth in claim 11 wherein said joint includes a silicon rubber joint.

15. The intermediate carrier device as set forth in claim 11 wherein each of said second arm ends are rounded for assisting in the placement of the bag onto the intermediate carrier device and for creating a plurality of contact points between the intermediate carrier device and the bag.

16. The intermediate carrier device as set forth in claim 11 further including the bag having the open end and the closed base, said bag being disposed about and in contact with each of the carrier arms for being held in the scrunched position.

17. The intermediate carrier device as set forth in claim 11 further including at least one support arm extending from said carrier base for engaging a packaging system and securing the intermediate carrier device on the packaging system.

18. The intermediate carrier device as set forth in claim 11, wherein the carrier base includes a first portion disposed on a first side of the base axis, a second portion disposed on a second side of the base axis, and a third portion disposed on a third side of the base axis, wherein the carrier base defines an opening on a fourth side of the base axis, and wherein the first side is opposite the third side, and the second side is opposite the fourth side.

19. The intermediate carrier device as set forth in claim 18, wherein a first carrier arm of the plurality of carrier arms is coupled to the carrier base between the first side of the base axis and the second side of the base axis, a second carrier arm of the plurality of carrier arms is coupled to the carrier base between the second side of the base axis and the third side of the base axis, a third carrier arm of the plurality of carrier arms is coupled to the carrier base between third side of the base axis and the fourth side of the base axis, and a fourth carrier arm of the plurality of carrier arms is coupled to the carrier base between the fourth side of the base axis and the first side of the base axis.

20. The intermediate carrier device as set forth in claim 11, wherein the plurality of carrier arms include a first carrier arm and a second carrier arm, the first carrier arm pivotally connected to said carrier base by a first pivotal connection for rotation about a first axis of rotation, the second carrier arm pivotally connected to said carrier base by a second pivotal connection for rotation about a second axis of rotation, the second axis of rotation being transverse to the first axis of rotation.

* * * * *